US011268050B2

(12) United States Patent
Vockenroth et al.

(10) Patent No.: US 11,268,050 B2
(45) **Date of Patent: *Mar. 8, 2022**

(54) DETERGENT OR CLEANING AGENT PORTION HAVING AT LEAST TWO PHASES

(71) Applicant: Henkel AG & Co. KGaA, Duesseldorf (DE)

(72) Inventors: Inga Kerstin Vockenroth, Duesseldorf (DE); Oliver Kurth, Angenfeld (DE); Luca Bellomi, Duesseldorf (DE); Klaus Dorra, Duesseldorf (DE); Matthias Sunder, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 21 days.

This patent is subject to a terminal disclaimer.

(21) Appl. No.: 16/521,533

(22) Filed: Jul. 24, 2019

(65) Prior Publication Data

US 2019/0345421 A1 Nov. 14, 2019

Related U.S. Application Data

(63) Continuation of application No. PCT/EP2018/051661, filed on Jan. 24, 2018.

(30) Foreign Application Priority Data

| | | |
|---|---|---|
| Jan. 24, 2017 | (DE) | 102017201094.0 |
| Jun. 16, 2017 | (DE) | 102017210141.5 |
| Jun. 16, 2017 | (DE) | 102017210143.1 |

(51) Int. Cl.

| | |
|---|---|
| ***C11D 17/04*** | (2006.01) |
| ***C11D 17/00*** | (2006.01) |
| ***C11D 11/00*** | (2006.01) |
| ***C11D 3/20*** | (2006.01) |
| ***C11D 3/37*** | (2006.01) |
| ***C11D 3/30*** | (2006.01) |

(52) U.S. Cl.

CPC ..... *C11D 17/0091* (2013.01); *C11D 3/2044* (2013.01); *C11D 3/2065* (2013.01); *C11D 3/30* (2013.01); *C11D 3/3707* (2013.01); *C11D 3/3753* (2013.01); *C11D 17/042* (2013.01); *C11D 17/044* (2013.01); *C11D 11/0023* (2013.01)

(58) Field of Classification Search

None

See application file for complete search history.

(56) References Cited

U.S. PATENT DOCUMENTS

| | | | | |
|---|---|---|---|---|
| 6,303,561 | B1 * | 10/2001 | Painter | C11D 17/0078 510/224 |
| 2004/0018953 | A1 * | 1/2004 | Kinloch | C11D 3/2068 510/503 |
| 2010/0113318 | A1 * | 5/2010 | Wiedemann | C11D 11/00 510/218 |
| 2011/0186467 | A1 * | 8/2011 | Denome | B65D 65/46 206/524.7 |
| 2012/0108487 | A1 * | 5/2012 | Graham | C11D 17/042 510/221 |
| 2016/0024447 | A1 * | 1/2016 | Simonsen | C11D 3/38627 510/393 |
| 2016/0102279 | A1 | 4/2016 | Labeque et al. | |
| 2018/0127692 | A1 * | 5/2018 | Coope-Epstein | C11D 1/72 |
| 2019/0085265 | A1 * | 3/2019 | Kurth | C11D 3/384 |
| 2019/0276779 | A1 * | 9/2019 | Sunder | C11D 3/3935 |

FOREIGN PATENT DOCUMENTS

| | | | |
|---|---|---|---|
| EP | 2924106 | A1 | 9/2015 |
| WO | 9924548 | A1 | 5/1999 |
| WO | 2004108876 | A1 | 12/2004 |
| WO | 2007033743 | A1 | 3/2007 |
| WO | 2017013156 | A1 | 1/2017 |
| WO | 20170131799 | A1 | 8/2017 |

OTHER PUBLICATIONS

International Search Report PCT/EP2018/051661 Completed: Mar. 26, 2018; dated Apr. 6, 2018 3 pages.

International Cosmetic Ingredient Dictionary and Handbook. 7th ed., Edited by John A. Wenninger et al., The Cosmetic, Toiletry and Fragrance Association (CTFA), Washington D.C., USA, 1997.

* cited by examiner

*Primary Examiner* — Lorna M Douyon

(74) *Attorney, Agent, or Firm* — Bojuan Deng

(57) ABSTRACT

A detergent or cleaning agent, in particular a cleaning agent for hard surfaces, especially an automatic dishwasher detergent, having a water-soluble envelope with a continuously encircling sealing seam and two phases which are different from one another.

18 Claims, No Drawings

DETERGENT OR CLEANING AGENT PORTION HAVING AT LEAST TWO PHASES

FIELD OF THE INVENTION

The present invention relates to a detergent or cleaning agent portion, in particular a cleaning agent for hard surfaces, in particular a dishwashing detergent, preferably an automatic dishwashing detergent, comprising a water-soluble wrapping having a continuous circumferential sealing seam, and two different phases.

BACKGROUND OF THE INVENTION

Detergents or cleaning agents are usually present in solid form (as tablets, for example) or in liquid form (or also as a flowing gel). Liquid detergents or cleaning agents in particular are increasingly popular with consumers.

Solid detergents or cleaning agents have the advantage that, unlike liquid detergents or cleaning agents, they do not require any preservatives. Liquid product formats are increasingly gaining acceptance in the market, particularly due to their quick solubility and the resulting quick availability of the active ingredients they contain. This gives the consumer the option of using abbreviated rinsing programs while still obtaining good cleaning performance.

Furthermore, consumers have grown accustomed to the convenient metering of pre-portioned machine detergents or cleaning agents, such as dishwashing detergents, and use these products in the form of tablets (solid detergents or cleaning agents) or in the form of pouches that are filled with what is usually a liquid detergent or cleaning agent. Single-use portions in water-soluble pouches are therefore increasingly popular with consumers not only because they no longer come into contact with the chemical composition, but also importantly because of the attractive appearance of the pouches. The appearance of the dosage form is becoming increasingly important. Besides good cleaning performance and adequate storage stability, a good appearance is one of the reasons on which the selection of a product is based.

BRIEF SUMMARY OF THE INVENTION

From the perspective of consumers, it would be desirable to combine the advantages of both product formats and provide a dosage form that is improved compared with the prior art, particularly for detergents or cleaning agents that are usually liquids. Both single-use portioning and a visual appearance that is attractive to consumers should be achieved simultaneously. Surprisingly, it has been found that this aim can be achieved by the formulation of a flexible phase that is combined with a granular mixture of a solid composition, in particular a powdered phase. It is particularly suitable for the granular mixture of a solid composition, in particular the powdered phase, to be free-flowing, because, owing to the process, it is possible to fill the water-soluble wrapping in a more targeted manner, in particular when filling a cavity produced by deep-drawing. Furthermore, raw materials can be incorporated more effectively and more easily; this is advantageous in particular when it comes to new raw materials or raw materials that would otherwise impair the compressibility of tablets.

In addition, the visual appearance of the granular mixture of a solid composition, in particular the powder, can be better changed compared with a compressed tablet; in particular texture differences, such as coarse and fine particles and particles or regions having different colors—in full or as colored flecks—can be used to improve a visually pleasing appearance. In addition, the granular mixture of the solid composition, in particular the powder, offers improved solubility in comparison with compressed tablets, even without the addition of disintegrants.

Within the meaning of the present invention, a powdered phase is understood to mean a granular mixture which is formed from a large number of loose, solid particles, which in turn comprise what are known as grains. According to the invention, the term "powdered phase" comprises powders and/or granules according to the following definition.

A granular mixture which is formed from a large number of loose, solid particles, which in turn comprise what are known as grains. A grain is a name for the particulate constituents of powders (grains are the loose, solid particles), dusts (grains are the loose solid particles), granules (loose, solid particles are agglomerates of several grains) and other granular mixtures. A preferred embodiment of the granular mixture of the composition of the first phase is the powder and/or the granular material. When reference is made to "powder" or "granules", this also includes these being mixtures of different powders or different granules. Accordingly, powder and granular material are intended to mean mixtures of different powders with different granules. Said solid particles of the granular mixture in turn preferably have a particle diameter $X_{50,3}$ (volume average) of from 10 to 1,500 μm, more preferably from 200 μm to 1,200 μm, particularly preferably from 600 μm to 1,100 μm. Said particle sizes can be determined by sieving or by means of a Camsizer particle size analyzer from the company Retsch.

The granular mixture of the solid composition of the present invention, which is used as a first phase, is preferably present in free-flowing form (particularly preferably as a free-flowing powder and/or free-flowing granular material). The agent of the portion according to the invention thus comprises at least one first phase of a free-flowing, granular mixture of a solid composition, in particular a powder, and at least one previously defined second phase.

In a first embodiment, the problem addressed by the present invention is therefore solved by a detergent or cleaning agent comprising a water-soluble wrapping having at least one continuous circumferential sealing seam that lies substantially in one plane, and at least one first phase and at least one second phase different therefrom, characterized in that the at least one first phase comprises a granular mixture of a solid composition, in particular in that the at least one first phase is powdered, in particular powdered and free-flowing, and the at least one second phase is at least one polymer and at least one polyhydric alcohol.

Within the meaning of the present invention, a phase is a spatial region in which physical parameters and the chemical composition are homogeneous. One phase differs from another phase in terms of its different features, such as ingredients, physical properties, external appearance, etc. Preferably, different phases can be differentiated visually from one another. A first phase can thus be clearly distinguished by a consumer from the at least one second phase. If the detergent or cleaning agent according to the invention has more than one first phase, then they can also each be distinguished from one another with the naked eye because of their different coloration, for example. The same holds when two or more second phases are present. In this case as well, a visual differentiation of the phases, for example on the basis of a difference in coloration or transparency, is possible. Within the meaning of the present invention, phases are thus self-contained regions that can be differentiated visually from one another by a consumer with the naked eye. The individual phases can have different characteristics when used, such as the speed at which the phase dissolves in water and hence the speed and the sequence of the release of the ingredients contained in the particular phase.

According to the invention, the at least one second phase is dimensionally stable at room temperature. During manufacture, the at least one polymer is brought into contact with the at least one polyhydric alcohol. This enables a flowable mixture to be obtained that can be molded into shape as desired. After a certain period of time, a second phase is obtained that remains in the predefined shape, i.e. is dimensionally stable. This time period, the setting time, is preferably 15 minutes or less, more preferably 10 minutes or less, particularly preferably 5 minutes or less. The at least one second phase yields on pressure yet is not deformed as a result, but rather returns to its initial state after the pressure has been removed. The at least one second phase is preferably elastic, particularly linear-elastic.

A shaped body is a single body that stabilizes itself in the shape imparted to it. This dimensionally stable body is formed from a molding compound (e.g. a composition) in such a way that this molding compound is deliberately brought into a predetermined shape, for example by pouring a liquid composition into a casting mold and then curing the liquid composition, for example as part of a sol-gel process.

According to a particularly preferred embodiment, the second phase, in particular the second phase, contains no dibenzylidene sorbitol. According to a particularly preferred embodiment, the second phase contains no benzylidene alditol compound.

According to a particularly preferred embodiment, agents of which the first phases comprise a granular mixture of a solid composition contain no dibenzylidene sorbitol in the at least one second phase, in particular no benzylidene alditol.

The at least one second phase is also preferably translucent or transparent, as a result of which a good visual impression is achieved. Preferably, the transmission of the second phase (without dye) is in a range between 100% and 20%, between 100% and 30%, in particular between 100% and 40%. To measure the light transmittance (transmission), the patency was determined in % at 600 nm against water as a reference at 20° C. For this purpose, the mass was poured into the designated 11 mm round cuvettes and measured after 12 h storage time at room temperature in a Lange LICO 300 color measuring system.

The at least one second phase is a solid gel phase. It is therefore sliceable. For example, it can be cut with a knife after it sets without being destroyed beyond the cut that is made. Moreover, the at least one second phase is particularly flexible. Due to its flexibility and elasticity, it can assume any shape. This also means that it has a level of breaking strength that enables good handling, particularly in terms of transport and storage, but also consumption.

DETAILED DESCRIPTION OF THE INVENTION

These and other aspects, features, and advantages of the invention will become apparent to a person skilled in the art through the study of the following detailed description and claims. Any feature from one aspect of the invention can be used in any other aspect of the invention. Furthermore, it will readily be understood that the examples contained herein are intended to describe and illustrate but not to limit the invention and that, in particular, the invention is not limited to these examples. Unless indicated otherwise, all percentages are indicated in terms of wt. %. Numerical ranges that are indicated in the format "from x to y" also include the stated values. If several preferred numerical ranges are indicated in this format, it is self-evident that all ranges that result from the combination of the various endpoints are also included.

"At least one", as used herein, means one or more, i.e., one, two, three, four, five, six, seven, eight, nine, or more. In relation to an ingredient, the expression refers to the type of ingredient and not to the absolute number of molecules. "At least one bleach catalyst" therefore means at least one type of bleach catalyst, for example—that is, that one type of bleach catalyst or a mixture of several different bleach catalysts can be used. Together with weight specifications, the expression relates to all compounds of the type indicated that are contained in the composition/mixture, that is to say that the composition does not contain any other compounds of this type beyond the indicated amount of the corresponding compounds.

When reference is made herein to molar masses, this information always refers to the number-average molar mass $M_n$ unless explicitly indicated otherwise. The number average of the molar mass can be determined, for example, by means of gel permeation chromatography (GPC) according to DIN 55672-1:2007-08 with THF as the eluent. The number-average molar mass $M_w$ can also be determined by means of GPC as described for $M_n$.

Unless explicitly indicated otherwise, all percentages that are cited in connection with the compositions described herein relate to wt. %, in each case with respect to the relevant mixture or phase.

The at least one first phase of the present invention comprises a granular mixture of a solid composition; in particular, it is powdered and free-flowing. The detergent or cleaning agent according to the invention therefore preferably comprises at least one first powdered and free-flowing phase as well as at least one second phase that comprises at least one polymer and at least one polyhydric alcohol.

The free-flowing ability of a granular mixture, in particular a powdered solid, the powdered phase, preferably the powder and/or granular material, relates to its ability to flow freely under its own weight. The free-flowing ability is determined by the flow time of 1,000 ml of detergent or cleaning agent powder out of a standardized flow-test funnel, which is initially closed in its discharge direction and has an outlet of 16.5 mm in diameter, being measured by measuring the time for the complete outflow of the granular mixture, in particular the powdered phase, preferably the powder and/or granular material, e.g. the powder, after opening the outlet, and being compared with the flow-out speed (in seconds) of a standard test sand of which the flow-out speed is defined as 100%. The defined sand mixture for calibrating the flow apparatus is dry sea sand. In this case, sea sand having a particle diameter of from 0.4 to 0.8 mm is used, as is available for example from Carl Roth, Germany CAS no. [14808-60-7]. For drying, the sea sand is dried, before the measurement for 24 h at 60° C., in a drying cabinet on a plate at a maximum layer height of 2 cm.

Granular mixtures of a solid composition, in particular powders having a free-flowing ability in %, compared with the above-mentioned standard test substance, of greater than 40%, preferably greater than 50, in particular greater than 55%, more preferably greater than 60%, particularly preferably between 63% and 80%, for example between 65% and 75%, are particularly suitable. Granular mixtures of a solid composition, in particular powders and/or granules, having a free-flowing ability in %, compared with the above-mentioned standard test substance, of greater than 40%, preferably greater than 45%, in particular greater than 50%, more preferably greater than 55%, particularly preferably greater than 60%, are particularly suitable, the free-flowing ability being measured 24 hours following the production of the powder and storage at 20° C.

Lower values for the free-flowing ability are rather unsuitable, since from a procedural point of view, precise dosing of the granular mixture, in particular the powder, is necessary. In particular, the values greater than 50%, in particular greater than 55%, preferably greater than 60% (where the measurement of the free-flowing ability is carried out 24 hours following the production of the powder and storage at 20° C.) have proved to be advantageous, since the good dosing ability of the granular mixture, in particular the powder, leads to only minor fluctuations in the dosed amount or composition. The more accurate dosing leads to consistent product performance, and economic losses due to overdosing are thus avoided. It is further advantageous for the granular mixture, in particular the powder, to be well dosed so that a faster sequence of the dosing process can be achieved. In addition, such a good free-flowing ability makes it easier to avoid the situation whereby the granular mixture, in particular the powder, reaches the part of the water-soluble wrapping which is provided for the sealing seam and therefore ought to remain as free as possible of grains, in particular powder-free.

Preferred embodiments of the first phases according to the invention have an angle of repose/angle of slope of from 26 to 35, preferably from 27 to 34, particularly preferably from 28 to 33, the repose angle being determined according to the method mentioned below after 24 h following the production of the granular mixture of the solid composition, in particular the powdered first phase, preferably the powder and/or granular material, and storage at 20° C. Such angles of repose have the advantage that the cavities can be filled with the at least one first phase comparatively quickly and precisely.

To determine the angle of repose (or also referred to as the angle of slope) of the at least one first phase, a powder funnel having a content of 400 ml and an outlet having a diameter of 25 mm is simply suspended in a tripod. The funnel is moved upwards by means of a manually operated knurling wheel at a speed of 80 mm/min such that the granular mixture, in particular the powdered phase, preferably the powder and/or granular material, e.g. the powder, flows out. As a result, what is known as a conical heap is formed. The conical heap height and the conical heap diameter are determined for the individual first phases. The angle of slope is calculated from the quotient of the conical heap height and the conical heap diameter*100.

For the measurement of the elasticity of the at least one second phase, a force-path diagram was created. The mass was poured into a 47×19×8 mm shaped body and stored at room temperature for 12 h before the measurement. The sample was taken in modified plastic inserts having external dimensions of 25×20×20 mm and having a recess of 10×10×20 mm for the mass to be measured. The measurement instrument used was a Lloyd LRX+ (Lloyd Instruments) having a 5 kN measuring head, with a feed rate of 50 mm/min and a measurement pickup at 1 N preload (zero point) having been set. As a result, the force necessary to compress the shaped body by 8 mm is given in N. Due to the elasticity of the shaped body, the initial dimensions of the shaped body are reset within a period of 15 minutes after the measurement has ended. The values measured in this way (for compression by 8 mm) are preferably between 10 N and 40 N, preferably between 15 N and 30 N.

Certain minimum requirements are placed on formulations of the at least one second phase. For instance, as already stated, the second phase must always set within as short a time as possible. Long setting times would result in excessively long production times and thus lead to high costs. According to the invention, "setting time" refers to the period of time during production within which the at least one second phase goes from a flowable state to a state that is non-flowable and dimensionally stable at room temperature. Room temperature is to be understood as a temperature of 20° C. Without constituting a restriction, this can be done through the crosslinking of the at least one polymer.

Furthermore, the second phase must be stable in storage, particularly in common storage conditions. The second phase according to the invention is a component of a detergent or cleaning agent. Detergents or cleaning agents are usually stored for a certain period of time in a household. They are usually stored near the washing machine or dishwasher. The second phase should be stable in such storage conditions. Therefore, the second phase should be stable and not deform or otherwise change in consistency over a storage period of for example 4 to 12 weeks, in particular 10 to 12 weeks or longer at a temperature of up to 40° C., especially 30° C., particularly 25° C. or 20° C.

The surface of the second phase should differ clearly from the first phase by a distinct luster, for example. The surface of the at least one first phase comprising a granular mixture, in particular the powdered phase, is usually not glossy but rather matte, dull, or muted, so that it is possible to make a clear distinction, on account of a luster, that makes the detergent or cleaning agent attractive to consumers.

A change in volume or shrinkage during storage would be disadvantageous, since that would diminish consumers' acceptance of the product. The leakage of liquid or the sweating-out of components from the second phase is also not desired. Here, too, the visual impression is relevant, for one. The stability of the second phase can be influenced by the leakage of liquid, such as solvent, so that the components are no longer stably contained, which can also impact the detergent or cleaning effect.

Moreover, it is preferable for the at least one first phase and the at least one second phase to be in direct contact with one another. In this case, there should no negative interaction between the first phase and the second phase. What no negative interaction means here, for example, is that no ingredients or solvents go from one phase into the other or that the stability, in particular storage stability, preferably for 4 weeks and at a storage temperature of 30° C., and/or the esthetics of the product are not impaired in any way, for example through a change in color, the formation of wet-looking edges, a blurred boundary between the two phases, or the like.

Surprisingly, it was found that an especially high level of storage stability is achieved if the second phase has little water. Having little water within the meaning of the present invention means that small amounts of water can be used to produce the at least one second phase. The proportion of water in the second phase is in particular 20 wt. % or less, preferably 15 wt. % or less, especially 12 wt. % or less, in particular between 10 and 5 wt. %. The specifications in wt. % refer to the total weight of the second phase. This has the advantage that the small amounts of water in combination with the at least one polymer (in particular in the case of PVOH and gelatin) can have a structure- or gel-forming effect.

According to a further embodiment, the at least one second phase is substantially water-free. This means that the second phase is preferably substantially free of water. "Substantially free" means here that small amounts of water can be contained in the second phase. For example, this water can be introduced into the phase by means of a solvent or as water of crystallization or as a result of reactions of components of the phase with each other. However, water is not introduced as a solvent for the production of the second phase. In this embodiment, the proportion of water in the second phase is 4.9 wt. % or less, 4 wt. % or less, preferably 2 wt. % or less, in particular 1 wt. % or less, especially 0.5 wt. % or less, more particularly particular 0.1 wt. % or 0.05 wt. % or less. The specifications in wt. % refer to the total weight of the second phase.

The at least one second phase comprises at least one polymer. The at least one polymer is particularly suitable for forming a network. According to the invention, the at least one second phase can have one polymer, two or more mutually different polymers. In particular, it has one, two, or more, particularly one or two, preferably one polymer that is suitable for forming a network. Moreover, the at least one second phase can have one or more polymers that do not form a network but result in a thickening and thus to an increasing of the dimensional stability of the at least one second phase—so-called thickening polymers. In a preferred embodiment, the at least one second phase thus comprises at least one, preferably one polymer for network formation, as well as one or more differing anionic polymers or anionic copolymers.

Preferably, the at least one second phase comprises PVOH (polyvinyl alcohol) and/or gelatin as polymers that are suitable for forming networks. Derivatives of PVOH are also suitable. Furthermore, the at least one second phase preferably comprises a further anionic polymer, in particular polycarboxylate. These can act either as builders and/or as thickening polymers.

Polyvinyl alcohols are thermoplastic materials that are manufactured as white to yellowish powders, usually by hydrolysis of polyvinyl acetate. Polyvinyl alcohol (PVOH) is resistant to almost all water-free organic solvents. Polyvinyl alcohols with a molar mass of from 30,000 to 60,000 g/mol are preferred.

Within the meaning of the invention, derivatives of PVOH are preferably copolymers of polyvinyl alcohol with other monomers, in particular copolymers with anionic monomers. Suitable anionic monomers are preferably vinyl acetic acid, alkyl acrylates, maleic acid and derivatives thereof, in particular monoalkyl maleates (in particular monomethyl maleate), dialkyl maleates (in particular dimethyl maleate), maleic anhydride, fumaric acid and derivatives thereof, in particular monoalkyl fumarate (in particular monomethyl fumarate), dialkyl fumarate (in particular dimethyl fumarate), fumaric anhydride, itaconic acid and its derivatives, in particular monomethyl itaconate, dialkyl itaconate, dimethyl itaconate, itaconic anhydride, citraconic acid (methylmaleic acid) and derivatives thereof, monoalkyl citraconic acid (in particular methyl citraconate), dialkyl citraconic acid (dimethyl citraconate), citraconic anhydride, mesaconic acid (methyl fumaric acid) and derivatives thereof, monoalkyl mesaconate, dialkyl mesaconate, mesaconic anhydride, glutaconic acid and derivatives thereof, monoalkyl glutaconate, dialkyl glutaconate, glutaconic anhydride, vinylsulfonic acid, alkyl sulfonic acid, ethylene sulfonic acid, 2-acrylamido-1-methylpropanesulfonic acid, 2-acrylamido-2-methylpropanesulfonic acid, 2-methylacrylamido-2-methylpropanesulfonic acid, 2-sulfoethyl acrylate and combinations thereof, and the alkali metal salts or esters of the above-mentioned monomers.

Particular preferred derivatives of PVOH are those selected from copolymers of polyvinyl alcohol with a monomer, in particular selected from the group of monoalkyl maleates (in particular monomethyl maleate), dialkyl maleates (in particular dimethyl maleate), maleic anhydride, and combinations thereof, and the alkali metal salts or esters of the above-mentioned monomers. The values given for polyvinyl alcohols themselves apply for the suitable molar masses.

In the context of the present invention, it is preferred for the at least one second phase to comprise a polyvinyl alcohol of which the degree of hydrolysis is preferably 70 to 100 mol. %, in particular 80 to 90 mol. %, particularly preferably 81 to 89 mol. %, and above all 82 to 88 mol. %.

Particularly preferred polyvinyl alcohols are those present as white-yellowish powders or granules having degrees of polymerization in the range of from approximately 100 to 2,500 (molar masses of from approximately 4,000 to 100,000 g/mol) and degrees of hydrolysis of from 80 to 99 mol. %, preferably from 80 to 90 mol. %, in particular from 87 to 89 mol. %, for example 88 mol. %, which accordingly also contain a residual content of acetyl groups.

PVOH powders having the aforementioned properties and suitable for use in the at least one second phase are sold, for example, under the name Mowiol® or Poval® by Kuraray. Particularly suitable are the Poval® grades, in particular grades 3-83, 3-88 and preferably 4-88, and Mowiol® 4-88 from Kuraray.

The water solubility of polyvinyl alcohol can be altered by post-treatment with aldehydes (acetalization) or ketones (ketalization). Especially preferred and, due to their decidedly good solubility in cold water, especially advantageous polyvinyl alcohols have been produced which can be acetalized or ketalized with the aldehyde or keto groups of saccharides or polysaccharides or mixtures thereof. It is extremely advantageous to use the reaction products of polyvinyl alcohol and starch. Furthermore, the water solubility can be altered and thus set at desired values in a targeted manner using Ni or Cu salts or by treatment with dichromates, boric acid, or borax.

Gelatin is a mixture of substances composed of taste-neutral animal protein. The main component is denatured or hydrolyzed collagen, which is produced from the connective tissue of various animal species. Gelatin lacks the essential amino acid tryptophan, so it is not considered to be a complete protein. Gelatin swells in water and dissolves when heated starting at about 50° C. When cooled, it forms a gel that liquefies again when reheated.

Surprisingly, it was found that PVOH and/or gelatin is especially well suited to producing second phases that meet the specifications outlined above. At least one second phase that comprises gelatin and/or PVOH as well as at least one polyhydric alcohol is therefore especially preferred. Particularly preferably, the at least one second phase comprises gelatin and at least one polyhydric alcohol. Particularly preferably, the at least one second phase comprises PVOH and at least one polyhydric alcohol.

According to the invention, the at least one second phase that is suitable for forming networks comprises suitable polymers in a proportion of from approximately 5 wt. % to 40 wt. %, in particular from 7 wt. % to 35 wt. %, preferably from 10 wt. % to 20 wt. %. Substantially lower proportions of polymers, in particular gelatin and/or PVOH, do not result in the formation of a stable gel-like second phase. The values are based in each case on the total weight of the second phase.

Surprisingly, it was found that, with the aid of gelatin, dimensionally stable second phases can be produced within a short curing time. Furthermore, the shape and size of phases manufactured in this way remain stable over a long period of time. No size-shrinkage is observed. Pig or bovine gelatin is preferably used as the gelatin. It has been observed that the quantity of gelatin necessary varies depending on the bloom value. Preferably, the second phase therefore has gelatin with a bloom value in the range of from 60 to 225. The bloom value describes the gel strength or gelling quality of gelatin. The characteristic number is the mass in grams that is required in order for a stamp measuring 0.5 inches in diameter to deform the surface of a 6.67% gelatin/water mixture four millimeters deep without breaking it. The experiment is conducted in a standardized manner at exactly 10° C. with previous aging of the gelatin for 17 hours.

If the at least one second phase comprises gelatin having a bloom value of 150 or more, in particular from 180 to 225, preferably from 200 to 225, then the proportion of gelatin with respect to the total weight of the second phase is preferably in the range of from 10 wt. % to 20 wt. %, in particular of from 15 wt. % to 18 wt. %. If the bloom value is less than 150, particularly from 60 to 120, preferably from 60 to 100, the proportion of gelatin with respect to the total weight of the second phase is preferably in the range of from 15 wt. % to 30 wt. %, in particular from 20 wt. % to 25 wt. %. Gelatin with a bloom value of 180 or more, in particular 200 or more, especially 225, is preferred. By using gelatin that has an appropriate bloom value the viscosity of the second phase can be monitored effectively during production. Additionally, the quantity of gelatin required in this case is less than when gelatins having a lower bloom value are used, which can result in a reduction in costs.

According to a most particularly preferred embodiment, the at least one second phase comprises PVOH (polyvinyl alcohol). Said second phases produced in this manner are particularly high melting, dimensionally stable (even at 40° C.) and do not change their shape, or do so only slightly, even during storage. In particular, they are also less reactive with respect to a direct negative interaction with components of the granular mixture, in particular the powder phase. In particular, PVOH can also produce second phases which have little water or are water-free, without difficulty. When PVOH is used as a polymer for the at least one second phase, highly fluid melts are produced at 110-120° C., which are thus particularly easy to process; in particular, the second phase can be poured into the water-soluble wrapping quickly and precisely without adhesion and without the amount being inaccurately dosed. Furthermore, said second phases adhere particularly well to the water-soluble wrapping, in particular if it is also made of PVOH. This is visually advantageous. Due to the rapid solidification of the at least one second phase comprising PVOH, the further processing of the second phases can take place particularly quickly. Furthermore, the good solubility of the produced second phases is particularly favorable for the overall solubility of the detergent or cleaning agent.

If the at least one second phase comprises gelatin in addition to PVOH, the tenacity of the second phase during production is increased.

Surprisingly, it was found that gelatin together with anionic polymers or copolymers, in particular with sulfopolymers, leads to the formation of second phases having non-sensitive surfaces. Such surfaces can be touched by an end consumer without having material adhere to their hands. Nor does any erosion of material occur in packaging. The second phase therefore preferably contains gelatin and an anionic copolymer/polymer. The proportion of anionic polymer is preferably 1 wt. % to 35 wt. %, in particular 3 wt. % to 30 wt. %, especially 4 wt. % to 25 wt. %, preferably 5 wt. % to 20 wt. %, for example 10 wt. %, based on the total weight of the second phase. Sulfopolymers also provide the surface with an outstanding luster. What is more, fingerprints are not left behind. Therefore, the proportion of sulfopolymers, in particular sulfopolymers having AMPS as a sulfonic acid group-containing monomer, for example Acusol 590, Acusol 588 or Sokalan CP50, is preferably 1 wt. % to 25 wt. %, in particular 3 wt. % to 15 wt. %, especially 4 wt. % to 12 wt. %, preferably 5 wt. % to 10 wt. %, based on the weight of the second phase. In a particularly preferred embodiment, the at least one second phase therefore comprises gelatin as well as a sulfopolymer (sulfonic acid group-containing acrylate copolymer) and at least one polyhydric alcohol.

According to the invention, the at least one second phase can further comprise anionic polymers or copolymers having builder properties. This is preferably a polycarboxylate. A copolymeric polyacrylate, preferably a sulfopolymer, preferably a copolymeric polysulfonate, preferably a hydrophobically modified copolymeric polysulfonate, is preferably used as the polycarboxylate. The copolymers can have two, three, four, or more different monomer units. Preferred copolymeric polysulfonates contain, besides sulfonic acid group-containing monomer(s), at least one monomer from the group of unsaturated carboxylic acids.

As the unsaturated carboxylic acid(s), unsaturated carboxylic acids of formula $R^1(R^2)C{=}C(R^3)COOH$ are especially preferably used, in which $R^1$ to $R^3$, independently of one another, represent —H, —$CH_3$, a straight-chain or branched saturated alkyl functional group having 2 to 12 carbon atoms, a straight-chain or branched, mono- or polyunsaturated alkenyl functional group having 2 to 12 carbon atoms, with —$NH_2$, —OH, or —COOH substituted alkyl or alkenyl functional groups as defined above, or represent —COOH or —$COOR^4$, where $R^4$ is a saturated or unsaturated, straight-chain or branched hydrocarbon functional group having 1 to 12 carbon atoms.

Particularly preferred unsaturated carboxylic acids are acrylic acid, methacrylic acid, ethacrylic acid, α-chloroacrylic acid, α-cyanoacrylic acid, crotonic acid, α-phenylacrylic acid, maleic acid, maleic anhydride, fumaric acid, itaconic acid, citraconic acid, methylene malonic acid, sorbic acid, cinnamic acid, or mixtures thereof. Unsaturated dicarboxylic acids can obviously also be used.

For sulfonic acid group-containing monomers, those of formula $R^5(R^6)C{=}C(R^7)$—X—$SO_3H$ are preferred, in which $R^5$ to $R^7$, independently of one another, represent —H, —$CH_3$, a straight-chain or branched saturated alkyl functional group having 2 to 12 carbon atoms, a straight-chain or branched, mono- or polyunsaturated alkenyl functional group having 2 to 12 carbon atoms, with —$NH_2$, —OH, or —COOH substituted alkyl or alkenyl functional groups, or represent —COOH or —$COOR^4$, where $R^4$ is a saturated or unsaturated, straight-chain or branched hydrocarbon functional group having 1 to 12 carbon atoms, and X represents an optionally present spacer group that is selected from —$(CH_2)_n$, where n=0 to 4, —COO—$(CH_2)_k$—, where k=1 to 6, —C(O)—NH—$C(CH_3)_2$—, —C(O)—NH—$C(CH_3)_2$—$CH_2$— and —C(O)—NH—$CH(CH_3)$—$CH_2$—.

Among these monomers, those of formulas $H_2C{=}CH$—X—$SO_3H$, $H_2C{=}C(CH_3)$—X—$SO_3H$ or $HO_3S$—X—$(R^6)$ $C{=}C(R^7)—X—SO_3H$ are preferred, in which $R^6$ and $R^7$, independently of one another, are selected from —H, $—CH_3$, $—CH_2CH_3$, $—CH_2CH_2CH_3$ and $—CH(CH_3)_2$, and X represents an optionally present spacer group that is selected from $—(CH_2)_n—$, where n=0 to 4, $—COO—(CH_2)_k—$, where k=1 to 6, $—C(O)—NH—C(CH_3)_2—$, $—C(O)—NH—C(CH_3)_2—CH_2—$ and $—C(O)—NH—CH(CH_3)—CH_2—$.

Particularly preferred sulfonic acid group-containing monomers are 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxy-propanesulfonic acid, allyl sulfonic acid, methallyl sulfonic acid, allyloxybenzene sulfonic acid, methallyloxybenzene sulfonic acid, 2-hydroxy-3-(2-propenyloxy)propanesulfonic acid, 2-methyl-2-propene-1-sulfonic acid, styrene sulfonic acid, vinylsulfonic acid, 3-sulfopropyl acrylate, 3-sulfopropyl methacrylate, sulfomethacrylamide, sulfomethylmethacrylamide, as well as mixtures of the above acids or water-soluble salts thereof. The sulfonic acid groups can be present in the polymers in a fully or partially neutralized form, i.e. the acidic hydrogen atom of the sulfonic acid group can be replaced in some or all of the sulfonic acid groups with metal ions, preferably alkali metal ions, and in particular with sodium ions. The use of partially or fully neutralized sulfonic acid group-containing copolymers is preferred according to the invention.

In copolymers that contain only carboxylic acid group-containing monomers and sulfonic acid group-containing monomers, the monomer distribution of the copolymers that are preferably used according to the invention is preferably 5 to 95 wt. % in each case; particularly preferably, the proportion of the sulfonic acid group-containing monomers is 50 to 90 wt. %, and the proportion of the carboxylic acid group-containing monomers is 10 to 50 wt. %, with the monomers preferably being selected from those mentioned above. The molar mass of the sulfo-copolymers that are preferably used according to the invention can be varied in order to adapt the characteristics of the polymers to the desired use. Preferred cleaning agents are characterized in that the copolymers have molar masses of from 2,000 to 200,000 $gmol^{-1}$, preferably 4,000 to 25,000 $gmol^{-1}$, and in particular 5,000 to 15,000 $gmol^{-1}$.

In another preferred embodiment, the copolymers comprise not only carboxyl group-containing monomers and sulfonic acid group-containing monomers but also at least one non-ionic, preferably hydrophobic monomer. In particular the rinsing performance of dishwashing detergents according to the invention was able to be improved by using these hydrophobically modified polymers.

Particularly preferably, the at least one second phase further comprises an anionic copolymer, with a copolymer comprising i) carboxylic acid group-containing monomers ii) sulfonic acid group-containing monomers iii) non-ionic monomers, in particular hydrophobic monomers being used as the anionic copolymer.

As the non-ionic monomers, monomers of general formula $R^1(R^2)C{=}C(R^3)—X—R^4$ are preferably used, in which $R^1$ to $R^3$ represent, independently of one another, —H, $—CH_3$ or $—C_2H_5$, X represents an optionally present spacer group selected from $—CH_2—$, —C(O)O— und —C(O)—NH—, and $R^4$ represents a straight-chain or branched saturated alkyl functional group having 2 to 22 carbon atoms or an unsaturated, preferably aromatic functional group having 6 to 22 carbon atoms.

Especially preferred non-ionic monomers are butene, isobutene, pentene, 3-methylbutene, 2-methylbutene, cyclopentene, hexene, hexene-1,2-methlypentene-1,3-methlypentene-1, cyclohexene, methylcyclopentene, cycloheptene, methylcyclohexene, 2,4,4-trimethylpentene-1,2,4,4-trimethylpentene-2,2,3-dimethylhexene-1,2,4-diemthylhexene-1,2,5-dimethlyhexene-1,3,5-dimethylhexene-1,4,4-dimethylhexane-1, ethylcyclohexene, 1-octene, α-olefins having 10 or more carbon atoms such as 1-decene, 1-dodecene, 1-hexadecene, 1-octadecene and $C_{22}$-α-olefin, 2-styrene, α-methylstyrene, 3-methylstyrene, 4-propylstyrene, 4-cyclohexylstyrene, 4-dodecylstyrene, 2-ethyl-4-benzylstyrene, 1-vinyl naphthalene, 2-vinyl naphthalene, acrylic acid methyl ester, acrylic acid ethyl ester, acrylic acid propyl ester, acrylic acid butyl ester, acrylic acid pentyl ester, acrylic acid hexyl ester, methacrylic acid methyl ester, N-(methyl)acrylamide, acrylic acid-2-ethylhexyl ester, methacrylic acid-2-ethylhexyl ester, N-(2-ethylhexyl)acrylamide, acrylic acid octyl ester, methacrylic acid octyl ester, N-(octyl)acrylamide, acrylic acid lauryl ester, methacrylic acid lauryl ester, N-(lauryl)acrylamide, acrylic acid stearyl ester, methacrylic acid stearyl ester, N-(stearyl)acrylamide, acrylic acid behenyl ester, methacrylic acid behenyl ester, and N-(behenyl)acrylamide or mixtures thereof, in particular acrylic acid, ethyl acrylate, 2-acrylamido-2-methylpropanesulfonic acid (AMPS) as well as mixtures thereof.

According to the invention the at least one second phase can also contain further polymers. Preference is given here to the presence of polyalkylene glycols, in particular polyethylene glycols in the second phase.

In particular, those polyethylene glycols having an average molar mass of between about 100 and 8,000 are suitable. The above-mentioned polyethylene glycols are particularly preferably used in amounts of from 1 to 40 wt. %, preferably from 5 to 35 wt. %, in particular from 10 to 30 wt. %, for example from 15 to 25, preferably in each case based on the total weight of the second phase.

Surprisingly, it was found that PVOH together with anionic polymers or copolymers, in particular with sulfopolymers, also leads to the formation of second phases having non-sensitive surfaces. Such surfaces can be touched by an end consumer without having material adhere to their hands. Nor does any erosion of material occur in packaging. The second phase therefore preferably contains PVOH and an anionic copolymer/polymer. The proportion of anionic polymer is preferably 1 wt. % to 35 wt. %, in particular 3 wt. % to 30 wt. %, especially 4 wt. % to 25 wt. %, preferably 5 wt. % to 20 wt. %, for example 10 wt. %, based on the total weight of the second phase. Sulfopolymers also provide the surface with an outstanding luster. Furthermore, fingerprints are not left behind. Therefore, the proportion of sulfopolymers, in particular sulfopolymers having AMPS as a sulfonic acid group-containing monomer, for example Acusol 590, Acusol 588 or Sokalan CP50, is preferably 1 wt. % to 25 wt. %, in particular 3 wt. % to 15 wt. %, especially 4 wt. % to 12 wt. %, preferably 5 wt. % to 10 wt. %, based on the weight of the second phase. In a particularly preferred embodiment, the at least one second phase therefore comprises PVOH as well as a sulfopolymer and at least one polyhydric alcohol.

According to a further preferred embodiment, in the at least one second phase, which also contains gelatin as a polymer, polyethylene glycols having an average molar mass of between approximately 200 and 8,000, between approximately 400 and 4,000 g/mol, particularly preferably having an average molar mass of between 1,000 and 2,000 g/mol, for example around 1,500 g/mol (INCI: PEG1500), are preferred, which increase the stability of the second phase. These can be used in the above-mentioned amounts. For example, in second phases comprising gelatin, based on the total weight of the at least one second phase, it is advantageous to use from 5 to 10 wt. % of polyethylene glycol having an average molar mass of between 1,000 and 2,000 g/mol.

A very particularly preferred embodiment relates to at least one second phase or phases which contain/s polyvinyl alcohol as a polymer in combination with polyethylene glycols. Particularly preferably, in combination with polyvinyl alcohol, polyethylene glycols having an average molar mass of between approximately 100 and approximately 2,000 g/mol, preferably between 200 and 1,000 g/mol, particularly preferably between 300 and 800 g/mol, for example approximately 400 g/mol (INCI: PEG400), are used.

In particular, it is advantageous for the at least one second phase or the second phases comprising polyvinyl alcohol to additionally contain polyethylene glycols having an average molar mass of from approximately 300 to 800 g/mol in amounts of from 10 to 30 wt. %, based on the total weight of the at least one second phase. Surprisingly, it was found that the addition of polyethylene glycols, in particular those having average molar masses of up to 800 g/mol, to the at least one second phase, in particular in second phases comprising polyvinyl alcohol, leads to an acceleration of the solidification time of the second phases. This is highly advantageous, in particular for the production sequences, since the further processing of the second phases in the solidified state can take place much more quickly and therefore usually less expensively.

The at least one second phase comprises at least one polyhydric alcohol. The at least one polyhydric alcohol enables the production of a dimensionally stable, non-flowable second phase within a short setting time that is within 15 minutes or less, in particular 10 minutes or less. Polyhydric alcohols within the meaning of the present invention are hydrocarbons in which two, three, or more hydrogen atoms are replaced by OH groups. The OH groups are each bonded to different carbon atoms. No carbon atom has two OH groups. This is in contrast with (simple) alcohols, in which only one hydrogen atom is replaced by an OH group in hydrocarbons. Polyhydric alcohols having two OH groups are referred to as alkanediols, and polyhydric alcohols having three OH groups are referred to as alkanetriols. A polyhydric alcohol thus corresponds to general formula [KW](OH)x, where KW represents a hydrocarbon that is linear or branched, saturated or unsaturated, substituted or unsubstituted. A substitution can occur with —SH or —NH groups, for example. Preferably, KW is a linear or branched, saturated or unsaturated, unsubstituted hydrocarbon. KW comprises at least two carbon atoms. The polyhydric alcohol comprises 2, 3, or more OH groups (x=2, 3, 4 . . . ), with only one OH group being bonded to each C atom of the KW. Particularly preferably, KW comprises 2 to 10, i.e. 2, 3, 4, 5, 6, 7, 8, 9, or 10, carbon atoms. Polyhydric alcohols in which x=2, 3, or 4 can be used in particular (for example, pentaerythritol where x=4). Preferably, x=2 (alkanediol) and/or x=3 (alkanetriol).

Particularly preferably, the at least one second phase comprises at least one alkanetriol and/or at least one alkanediol, in particular at least one $C_3$ to $C_{10}$ alkanetriol and/or at least one $C_3$ to $C_{10}$ alkanediol, preferably at least one $C_3$ to $C_8$ alkanetriol and/or at least one $C_3$ to $C_8$ alkanediol, especially at least one $C_3$ to $C_6$ alkanetriol and/or at least one $C_3$ to $C_5$ alkanediol, as a polyhydric alcohol. Preferably, it comprises one alkanetriol and one alkanediol as at least one polyhydric alcohol. In a preferred embodiment, the at least second phase thus comprises at least one polymer, in particular gelatin and/or PVOH, as well as at least one alkanediol and at least one alkanetriol, in particular one alkanetriol and one alkanediol. A second phase comprising at least one polymer, in particular gelatin and/or PVOH, and a $C_3$ to $C_8$ alkanediol and a $C_3$ to $C_8$ alkanetriol, is also preferred. A second phase comprising at least one polymer, in particular gelatin and/or PVOH, and a $C_3$ to $C_5$ alkanediol and a $C_3$ to $C_6$ alkanetriol, is also preferred.

Surprisingly, it was found that, when a suitable triol (alkanetriol) is combined with a suitable diol (alkanediol), especially short setting times can be achieved. Furthermore, the second phases that are obtained are transparent and have a shiny surface, which provides for an attractive visual impression of the detergent or cleaning agent according to the invention. The terms "diol" and "alkanediol" are used synonymously herein. The same applies to "triol" and "alkanetriol".

According to the invention, the polyhydric alcohols do not comprise any derivatives thereof, such as ethers, esters, etc.

The amount of polyhydric alcohol or polyhydric alcohols used in second phases according to the invention is preferably at least 45 wt. %, in particular 55 wt. % or more. Preferred amount ranges are from 5 wt. % to 75 wt. %, in particular from 10 wt. % to 70 wt. %, based on the total weight of the second phase.

Preferably, the $C_3$ to $C_6$ alkanetriol is glycerin and/or 2-ethyl-2-(hydroxymethyl)-1,3-propanediol (also called 1,1,1-trimethylolpropane or EHPD) and/or 2-amino-2-(hydroxymethyl)-1,3-propanediol (TRIS, tris hydroxymethyl aminoethane).

The $C_3$ to $C_6$ alkanetriol is particularly preferably glycerin and/or 2-ethyl-2-(hydroxymethyl)-1,3-propanediol (also called 1,1,1-trimethylolpropane). The $C_3$ to $C_5$ alkanediol is preferably 1,3-propanediol and/or 1,2-propanediol. Surprisingly, it was found that the chain length of the diol as well as, in particular, the position of the OH groups has an influence on the transparency of the second phase. The OH groups of the diol are therefore preferably not arranged on immediately adjacent C atoms. In particular, three or four carbon atoms, in particular 3 carbon atoms, are located between the two OH groups of the diol. Particularly preferably, the diol is 1,3-propanediol. Surprisingly, it was found that especially good results are obtained with mixtures that comprise glycerin and 1,3-propanediol and/or 1,2-propanediol.

Especially preferably, the second phase comprises gelatin, glycerin, and 1,3-propanediol or gelatin, 1,1,1-trimethylolpropane and 1,3-propanediol. In this case, a dimensionally stable, non-flowable consistency at room temperature can be achieved within a setting time of 10 minutes or less and remains dimensionally stable even after an extended storage period. In addition, such a phase is transparent and has a shiny surface. An especially preferred second phase therefore comprises gelatin or PVOH as a polymer and 1,3-propanediol and glycerin or 1,1,1-trimethylolpropane as polyhydric alcohols.

If the second phase comprises an alkanetriol, in particular glycerin or 1,1,1-trimethylolpropane, then the proportion of alkanetriol, in particular glycerin or 1,1,1-trimethylolpropane, is between 3 and 75 wt. %, preferably 5 wt. % to 70 wt. %, in particular 10 wt. % to 65 wt. %, especially 20 wt. % to 40 wt. %, based on the total weight of the second phase.

If the second phase optionally comprises a plurality of alkanetriol(s), then the proportion of alkanetriol(s) is between 3 and 75 wt. %, preferably 5 wt. % to 70 wt. %, in particular 10 wt. % to 65 wt. %, especially 20 wt. % to 40 wt. %, based on the total weight of the second phase.

If glycerin is contained as an alkanetriol in the second phase, then the proportion of glycerin based on the total weight of the second phase is preferably 5 wt. % to 70 wt. %, particularly 10 wt. % to 65 wt. %, especially 20 wt. % to 40 wt. %.

If 1,1,1-trimethylolpropane is contained in the second phase, then the proportion of 1,1,1-trimethylolpropane based on the total weight of the second phase is preferably 5 wt. % to 70 wt. %, in particular 10 wt. % to 65 wt. %, especially preferably 18 to 45 wt. %, particularly preferably 20 wt. % to 40 wt. %.

If 2-amino-2-hydroxymethyl-1,3-propanediol is contained in the second phase, then the proportion of 2-amino-2-hydroxymethyl-1,3-propanediol based on the total weight of the second phase is preferably 5 wt. % to 70 wt. %, in particular 10 wt. % to 65 wt. %, especially 20 wt. % to 40 wt. %.

If a plurality of alkanediols are optionally contained in the second phase, then the proportion of alkanediols based on the total weight of the second phase is preferably 5 wt. % to 70 wt. %, in particular 7 wt. % to 65 wt. %, especially 10 wt. % to 40 wt. %.

If the second phase comprises at least one alkanediol, in particular 1,3-propanediol or 1,2-propanediol, then the proportion of alkanediol, in particular 1,3-propanediol or 1,2-propanediol, based on the total weight of the second phase, is preferably 5 wt. % to 70 wt. %, in particular 10 wt. % to 65 wt. %, especially 20 wt. % to 45 wt. %. If 1,3-propanediol is contained in the second phase, then the proportion of 1,3-propanediol based on the total weight of the second phase is in particular 10 wt. % to 65 wt. %, especially 20 wt. % to 45 wt. %.

A second phase is preferred which contains 20 to 45 wt. % 1,3-propanediol and/or 1,2-propanediol and 10 wt. % to 65 wt. % 2-amino-2-hydroxymethyl-1,3-propanediol, in each case based on the total weight of the second phase. Also preferred is a second phase which contains 20 to 45 wt. % 1,3-propanediol and/or 1,2-propanediol and 10 wt. % to 65 wt. % 1,1,1-trimethylolpropane, in each case based on the total weight of the second phase. A second phase is particularly preferred which contains 20 to 45 wt. % 1,3-propanediol and/or 1,2-propanediol and 10 wt. % to 65 wt. % glycerin, in each case based on the total weight of the second phase.

It was found that, in these ranges, quick setting of a second phase is possible at 20° C. and yields phases that are stable in storage and transparent. In particular, the glycerin proportion has an impact on the curing time.

If the at least one second phase according to the invention comprises a $C_3$ to $C_6$ alkanetriol and a $C_3$ to $C_5$ alkanediol, then the weight ratio thereof is preferably 3:1 to 2:1. In particular, the weight ratio is 2:1 if glycerin and 1,3-propanediol are contained as polyhydric alcohols. Surprisingly, it was found that, with these weight ratios, storage-stable, shiny, transparent second phases can be obtained within short setting times of 10 minutes or less at 20° C.

According to a further preferred embodiment, in addition to the above-mentioned alkanols, triethylene glycol may be present in the at least one second phase, in particular the second phases described above as being preferred, especially if this phase contains PVOH as a polymer. Triethylene glycol advantageously accelerates the solidification of the second phase(s). It is particularly preferred if the at least one second phase, in addition to 1,3- and/or 1,2-propanediol and glycerin, contains between 0.1 and 20 wt. %, preferably between 1 and 15 wt. %, in particular between 5 and 12 wt. %, for example 8 to 11 wt. %, triethylene glycol.

Very particularly preferred embodiments of the present invention comprise, as at least one second phase, 8 to 20 wt. % PVOH, 15 to 30 wt. % 1,3-propanediol, 30 to 40 wt. % glycerin, 5 to 15 wt. % sulfonic acid group-containing polyacrylate copolymer, optionally 2 to 10 wt. % 1,2-propanediol, and optionally 2-15 wt. % triethylene glycol or polyethylene glycol (preferably having an average molar mass of from 200-600 g/mol), in each case based on the total weight of the second phase.

The detergent or cleaning agent according to the invention preferably comprises at least one surfactant. This surfactant is selected from the group of the anionic, non-ionic, and cationic surfactants. The detergent or cleaning agent according to the invention can also contain mixtures of several surfactants that are selected from the same group.

According to the invention, the at least one first phase and the at least one second phase each contain at least one surfactant. It is also possible, however, for only the at least one first phase or only the at least one second phase to comprise at least one surfactant.

If both phases comprise a surfactant, then they are preferably different surfactants. It is also possible, however, for the first and second phases to have the same surfactant or surfactants. The at least one first and/or second phases according to the invention preferably contain at least one non-ionic surfactant. All non-ionic surfactants that are known to a person skilled in the art can be used as non-ionic surfactants. Preferably, low-foaming non-ionic surfactants are used, in particular alkoxylated, especially ethoxylated, low-foaming non-ionic surfactants. These will be specified in greater detail below.

Suitable non-ionic surfactants include alkyl glycosides of general formula $RO(G)_x$, for example, in which R corresponds to a primary straight-chain or methyl-branched aliphatic functional group, in particular an aliphatic functional group that is methyl-branched in the 2 position, having 8 to 22, preferably 12 to 18, C atoms, and G is the symbol that represents a glycose unit having 5 or 6 C atoms, preferably glucose. The degree of oligomerization x, which indicates the distribution of monoglycosides and oligoglycosides, is any number between 1 and 10; x is preferably between 1.2 and 1.4.

Another class of preferably used non-ionic surfactants, which are used either as the sole non-ionic surfactant or in combination with other non-ionic surfactants, are alkoxylated, preferably ethoxylated or ethoxylated and propoxylated fatty acid alkyl esters, preferably having 1 to 4 carbon atoms in the alkyl chain.

Non-ionic surfactants of the amine oxide type, for example N-cocoalkyl-N,N-dimethylamine oxide and N-tallowalkyl-N,N-dihydroxyethylamine oxide, and of the fatty acid alkanolamides may also be suitable. The amount of these non-ionic surfactants is preferably no more than that of the ethoxylated fatty alcohols, in particular no more than half thereof.

Additional suitable surfactants are the polyhydroxy fatty acid amides that are known as PHFAs. Especially preferably, the detergents or cleaning agents according to the invention, in particular cleaning agents for dishwashers, contain non-ionic surfactants from the group of alkoxylated alcohols.

Non-ionic surfactants that are preferably used are alkoxylated, advantageously ethoxylated, in particular primary alcohols having preferably 8 to 18 C atoms and, on average, 1 to 12 mol of ethylene oxide (EO) per mol of alcohol, in which the alcohol functional group can be linear or preferably methyl-branched in the 2 position, or can contain linear and methyl-branched functional groups in admixture, as are usually present in oxo alcohol functional groups. However, alcohol ethoxylates having linear functional groups of alcohols of native origin having 12 to 18 C atoms, for example of coconut alcohol, palm alcohol, tallow fatty alcohol or oleyl alcohol, and an average of 2 to 8 mol EO per mol of alcohol, are particularly preferred. Examples of preferred ethoxylated alcohols include $C_{12-14}$ alcohols having 3 EO or 4 EO, $C_{8-11}$ alcohol having 7 EO, $C_{13-15}$ alcohols having 3 EO, 5 EO, 7 EO or 8 EO, $C_{12-18}$ alcohols having 3 EO, 5 EO or 7 EO, and mixtures thereof, such as mixtures of $C_{12-14}$ alcohol having 3 EO and $C_{12-18}$ alcohol having 5 EO.

Preferred alcohol ethoxylates have a narrowed homolog distribution (narrow range ethoxylates, NRE). In addition to these non-ionic surfactants, fatty alcohols having more than 12 EO can also be used. Examples of these are tallow fatty alcohols having 14 EO, 25 EO, 30 EO, or 40 EO.

Ethoxylated non-ionic surfactants are especially preferably used which were obtained from $C_{6-20}$ monohydroxy alkanols or $C_{6-20}$ alkyl phenols or $C_{16-20}$ fatty alcohols and more than 12 mol, preferably more than 15 mol, and in particular more than 20 mol ethylene oxide per mol of alcohol. An especially preferred non-ionic surfactant is obtained from a straight-chain fatty alcohol having 16 to 20 carbon atoms ($C_{16-20}$ alcohol), preferably from a $C_{18}$ alcohol and at least 12 mol, preferably at least 15 mol and in particular at least 20 mol of ethylene oxide. Among these, the so-called "narrow-range ethoxylates" are especially preferred.

Surfactants that are preferably used come from the groups of the alkoxylated non-ionic surfactants, in particular the ethoxylated primary alcohols and mixtures of these surfactants with structurally complex surfactants such as polyoxypropylene/polyoxyethylene/polyoxypropylene ((PO/EO/PO) surfactants). Such (PO/EO/PO) non-ionic surfactants are also characterized by good foam control.

In the context of the present invention, low-foaming non-ionic surfactants which have alternating ethylene oxide and alkylene oxide units have proven to be especially preferred. Among these, in turn, surfactants having EO-AO-EO-AO blocks are preferred, with one to ten EO groups and AO groups being bonded to each other in each case, before a block follows from the respective other groups. Here, non-ionic surfactants of general formula $$R^1-O-(CH_2-CH_2-O)_w-(CH_2-\underset{\underset{R^2}{|}}{CH}-O)_x-(CH_2-CH_2-O)_y-(CH_2-\underset{\underset{R^3}{|}}{CH}-O)_z-H$$

are preferred, in which $R^1$ represents a straight-chain or branched, saturated or mono- or polyunsaturated $C_{6-24}$ alkyl or alkenyl functional group; each $R^2$ and $R^3$ group is selected, independently of one another, from $—CH_3$, $—CH_2CH_3$, $—CH_2CH_2—CH_3$, $—CH(CH_3)_2$, and the indices w, x, y, z, independently of one another, represent integers from 1 to 6.

Preferred non-ionic surfactants of the above formula can be produced using known methods from the corresponding alcohols $R^1$—OH and ethylene or alkylene oxide. The $R^1$ functional group in the above formula can vary depending on the origin of the alcohol. If native sources are used, the $R^1$ functional group has an even number of carbon atoms and is generally unbranched, with the linear functional groups of alcohols of native origin having 12 to 18 C atoms, such as coconut alcohol, palm alcohol, tallow fatty alcohol, or oleyl alcohol, for example, being preferred. Some examples of alcohols that are available from synthetic sources are the Guerbet alcohols or functional groups that are methyl-branched or linear and methyl-branched in the 2 position in admixture, such as those usually present in oxo-alcohol functional groups. Independently of the approach taken in the manufacture of the alcohol used in the non-ionic surfactants contained in the agents, non-ionic surfactants are preferred in which $R^1$ represents an alkyl functional group having 6 to 24, preferably 8 to 20, especially preferably 9 to 15, and in particular 9 to 11 carbon atoms in the above formula.

Besides propylene oxide, butylene oxide in particular is worthy of consideration as an alkylene oxide unit that is contained alternately with the ethylene oxide unit in the preferred non-ionic surfactants. However, other alkylene oxides in which $R^2$ and $R^3$ are selected, independently of one another, from $—CH_2CH_2—CH_3$ and $—CH(CH_3)_2$ are also suitable. Preferably, non-ionic surfactants of the above formula are used in which $R^2$ and $R^3$ represent a functional group $—CH_3$; w and x, independently of one another, represent values of 3 or 4; and y and z, independently of one another, represent values of 1 or 2.

Further preferably used non-ionic surfactants of the first phase are non-ionic surfactants of the general formula $R^1O(AlkO)_xM(OAlk)_yOR^2$, where $R^1$ and $R^2$, independently of one another, represent a branched or unbranched, saturated or unsaturated, optionally hydroxylated, alkyl functional group having 4 to 22 carbon atoms; Alk represents a branched or unbranched alkyl functional group having 2 to 4 carbon atoms; x and y represent, independently of one another, values of between 1 and 70; and M represents an alkyl functional group from the group $CH_2$, $CHR^3$, $CR^3R^4$, $CH_2CHR^3$ and $CHR^3CHR^4$, where $R^3$ and $R^4$, independently of one another, represent a branched or unbranched, saturated or unsaturated, alkyl functional group having 1 to 18 carbon atoms.

Preferred in this case are non-ionic surfactants of the general formula $$R^1—CH(OH)CH_2—O(CH_2CH_2O)_xCH_2CHR(OCH_2CH_2)_y—CH_2CH(OH)—R^2,$$

where R, $R^1$ and $R^2$, independently of one another, represent an alkyl functional group or alkenyl functional group having 6 to 22 carbon atoms; x and y, independently of one another, represent values of between 1 and 40.

Preferred in this case are, in particular, compounds of the general formula $$R^1—CH(OH)CH_2—O(CH_2CH_2O)_xCH_2CHR(OCH_2CH_2)_yO—CH_2CH(OH)—R^2,$$

in which R represents a linear, saturated alkyl functional group having 8 to 16 carbon atoms, preferably 10 to 14 carbon atoms, and n and m represent, independently of one another, values of from 20 to 30. Such compounds can be obtained, for example, by reacting alkyl diols HO—CHR—$CH_2$—OH with ethylene oxide, with a reaction with an alkyl epoxide being performed subsequently in order to close the free OH functions whilst forming a dihydroxy ether.

Preferred non-ionic surfactants in this case are those of general formula $R^1$—CH(OH)$CH_2$O-$(AO)_w$-$(AO)_x$-$(A''O)_y$-$(A'''O)_z$—$R^2$, in which

- $R^1$ represents a straight-chain or branched, saturated or mono- or polyunsaturated $C_{6-24}$ alkyl functional group or alkenyl functional group;
- $R^2$ represents hydrogen or a linear or branched hydrocarbon functional group having 2 to 26 carbon atoms;
- A, A', A'' and A''' represent, independently of one another, a functional group from the group —$CH_2CH_2$, —$CH_2CH_2$—$CH_2$, —$CH_2$—CH($CH_3$), —$CH_2$—$CH_2$—$CH_2$—$CH_2$, —$CH_2$—CH($CH_3$)—$CH_2$—, —$CH_2$—CH($CH_2$—$CH_3$);
- w, x, y and z represent values of between 0.5 and 120, where x, y and/or z can also be 0.

By adding the above-mentioned non-ionic surfactants of general formula $R^1$—CH(OH)$CH_2$O-$(AO)_w$-$(A'O)_x$-$(A''0)_y$-$(A'''O)_z$—$R^2$, hereinafter also referred to as "hydroxy mixed ethers," the cleaning performance of preparations according to the invention can surprisingly be substantially improved, particularly both in comparison with surfactant-free systems and in comparison with systems that contain alternative non-ionic surfactants, such as those from the group of polyalkoxylated fatty alcohols, for example.

By using these non-ionic surfactants having one or more free hydroxyl groups on one or both terminal alkyl functional groups, the stability of the enzymes contained in the cleaning agent preparations according to the invention can be improved substantially.

In particular, those end-capped poly(oxyalkylated) non-ionic surfactants are preferred which, according to the following formula

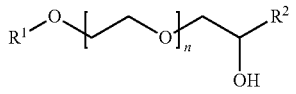

besides a functional group $R^1$, which represents linear or branched, saturated or unsaturated, aliphatic or aromatic hydrocarbon functional groups having 2 to 30 carbon atoms, preferably having 4 to 22 carbon atoms, also have a linear or branched, saturated or unsaturated, aliphatic or aromatic hydrocarbon functional group $R^2$ having 1 to 30 carbon atoms, where n represents values of between 1 and 90, preferably values of between 10 and 80, and in particular values of between 20 and 60. Surfactants of the above formula are particularly preferred in which $R^1$ represents $C_7$ to $C_{13}$, n represents a whole natural number from 16 to 28, and $R^2$ represents $C_8$ s to $C_{12}$.

Surfactants of formula $R^1O[CH_2CH(CH_3)O]_x[CH_2CH_2O]_yCH_2CH(OH)R^2$ are particularly preferred, in which $R^1$ represents a linear or branched aliphatic hydrocarbon functional group having 4 to 18 carbon atoms or mixtures thereof, $R^2$ represents a linear or branched hydrocarbon functional group having 2 to 26 carbon atoms or mixtures thereof, and x represents values of between 0.5 and 1.5, and y represents a value of at least 15. The group of these non-ionic surfactants includes for example the $C_{2-26}$ fatty alcohol $(PO)_1$-$(EO)_{15-40}$-2-hydroxyalkyl ethers, in particular including the $C_{8-10}$ fatty alcohol $(PO)_1$-$(EO)_{22}$-2-hydroxydecyl ethers.

Furthermore, those end-capped poly(oxyalkylated) non-ionic surfactants of formula $R^1O[CH_2CH_2O]_x[CH_2CH(R^3)O]_yCH_2CH(OH)R^2$ are particularly preferred in which $R^1$ and $R^2$, independently of one another, represent a linear or branched, saturated or mono- or polyunsaturated hydrocarbon functional group having 2 to 26 carbon atoms, $R^3$, independently of one another, is selected from —$CH_3$, —$CH_2CH_3$, —$CH_2CH_2$—$CH_3$, —$CH(CH_3)_2$, but preferably represents —$CH_3$, and x and y, independently of one another, represent values between 1 and 32, with non-ionic surfactants in which $R^3$=—$CH_3$ and having values for x of from 15 to 32 and for y of from 0.5 and 1.5 being very particularly preferred.

Further preferably used non-ionic surfactants which can be used are the end-capped poly(oxyalkylated) non-ionic surfactants of formula $R^1O[CH_2CH(R^3)O]_x[CH_2]_kCH(OH)[CH_2]_jOR^2$, in which $R^1$ and $R^2$ represent linear or branched, saturated or unsaturated, aliphatic or aromatic hydrocarbon functional groups having 1 to 30 carbon atoms, $R^3$ represents H or a methyl, ethyl, n-propyl, iso-propyl, n-butyl, 2-butyl or 2-methyl-2-butyl functional group, x represents values between 1 and 30, and k and j represent values between 1 and 12, preferably between 1 and 5.

If the value is x>2, each $R^3$ in the above formula $R^1O[CH_2CH(R^3)O]_x[CH_2]kCH(OH)[CH_2]_jR^2$ can be different. $R^1$ and $R^2$ are preferably linear or branched, saturated or unsaturated, aliphatic or aromatic hydrocarbon functional groups having 6 to 22 carbon atoms, with functional groups having 8 to 18 C atoms being particularly preferred. For the functional group $R^3$, H, —$CH_3$ or —$CH_2CH_3$ are particularly preferred. Especially preferred values for x lie in the range of from 1 to 20, in particular from 6 to 15.

As described above, each $R^3$ in the above formula can be different if x>2. As a result, the alkylene oxide unit in the square brackets can be varied. For example, if x represents 3, the functional group $R^3$ can be selected in order to form ethylene oxide ($R^3$=H) or propylene oxide ($R^3$=$CH_3$) units, which can be joined together in any sequence, for example (EO)(PO)(EO), (EO)(EO)(PO), (EO)(EO)(EO), (PO)(EO)(PO), (PO)(PO)(EO) and (PO)(PO)(PO). The value 3 for x has been selected here by way of example and can by all means be greater, in which case the range of variation increases as the values for x increase and includes a large number of (EO) groups combined with a small number of (PO) groups, for example, or vice versa.

Particularly preferred end-capped poly(oxyalkylated) alcohols of the above formula have values of k=1 and j=1, and therefore the previous formula is simplified to $R^1O[CH_2CH(R^3)O]XCH_2CH(OH)CH_2OR^2$. In the above-mentioned formula, $R^1$, $R^2$ and $R^3$ are as defined above and x represents numbers from 1 to 30, preferably 1 to 20, and in particular 6 to 18. Surfactants in which the functional groups $R^1$ and $R^2$ have 9 to 14 C atoms, $R^3$ represents H, and x assumes values from 6 to 15 are particularly preferred. Finally, the non-ionic surfactants of general formula $R^1$—CH(OH)$CH_2$O-$(AO)_w$—$R^2$ have proven to be particularly effective, in which

- $R^1$ represents a straight-chain or branched, saturated or mono- or polyunsaturated $C_{6-24}$ alkyl functional group or alkenyl functional group;
- $R^2$ represents a linear or branched hydrocarbon functional group having 2 to 26 carbon atoms;
- A represents a functional group from the group $CH_2CH_2$, $CH_2CH_2CH_2$, $CH_2CH(CH_3)$, preferably $CH_2CH_2$, and
- w represents values between 1 and 120, preferably 10 to 80, particularly 20 to 40.

The group of these non-ionic surfactants includes, for example, the $C_{4-22}$ fatty alcohol-$(EO)_{10-80}$-2-hydroxyalkyl ethers, in particular including the $C_{8-12}$ fatty alcohol-$(EO)_{22}$-2-hydroxydecyl ethers and the $C_{4-22}$ fatty alcohol-$(EO)_{40-80}$-2-hydroxyalkyl ethers.

Preferably, the at least one first and/or the at least one second phase contains at least one non-ionic surfactant, preferably a non-ionic surfactant from the group of the hydroxy mixed ethers, with the proportion by weight of the non-ionic surfactant with respect to the total weight of the second phase being preferably 0.5 wt. % to 30 wt. %, more preferably 5 wt. % to 25 wt. %, and in particular 10 wt. % to 20 wt. %.

In another preferred embodiment, the non-ionic surfactant of the first and/or second phase is selected from non-ionic surfactants of general formula $R^1—O(CH_2CH_2O)_xCR^3R^4(OCH_2CH_2)_yO—R^2$, in which $R^1$ und $R^2$, independently of one another, represent an alkyl functional group or alkenyl functional group having 4 to 22 carbon atoms; $R^3$ und $R^4$ represent, independently of one another, H or an alkyl functional group of alkenyl functional group having 1 to 18 carbon atoms, and x and y represent, independently of one another, values between 1 and 40.

In particular, compounds of general formula $R^1—O(CH_2CH_2O)_xCR^3R^4(OCH_2CH2)_yO—R^2$ are preferred, in which $R^3$ and $R^4$ represent H and the indices x and y, independently of one another, assume values from 1 to 40, preferably from 1 to 15.

In particular, compounds of general formula $R^1—O(CH_2CH_2O)_xCR^3R^4(OCH_2CH_2)_yO—R^2$ are especially preferred, in which the functional groups $R^1$ and $R^2$, independently of one another, represent saturated alkyl functional groups having 4 to 14 carbon atoms and the indices x and y, independently of one another, assume values from 1 to 15 and in particular from 1 to 12.

In addition, such compounds of general formula $R^1—O(CH_2CH_2O)_xCR^3R^4(OCH_2CH_2)_yO—R^2$ are preferred in which one of the functional groups $R^1$ and $R^2$ is branched.

Compounds of general formula $R^1—O(CH_2CH_2O)_xCR^3R^4(OCH_2CH_2)_yO—R^2$ are very especially preferred in which the indices x and y, independently of one another, assume values from 8 to 12.

The indicated C chain lengths and degrees of ethoxylation or degrees of alkoxylation of the non-ionic surfactants represent statistical averages that can be an integer or a fraction for a given product. Owing to the manufacturing methods, commercial products of the above-mentioned formulas generally do not consist of an individual representative, but of mixtures, for which reason average values and, resulting from those, fractional numbers can arise both for the C chain lengths and for the degrees of ethoxylation and degrees of alkoxylation.

Naturally, the aforementioned non-ionic surfactants can be used not only as individual substances but also as surfactant mixtures of two, three, four, or more surfactants.

In the at least one first phase, those non-ionic surfactants are particularly preferred which have a melting point above room temperature. Non-ionic surfactant(s) having a melting point above 20° C., preferably above 25° C., particularly preferably between 25 and 60° C., and particularly between 26.6 and 43.3° C., is/are especially preferred.

Suitable non-ionic surfactants having melting or softening points in the above-mentioned temperature range include low-foaming non-ionic surfactants, for example, which can be solid or highly viscous at room temperature. If non-ionic surfactants are used which are highly viscous at room temperature, then it is preferred that they have a viscosity above 20 Pa·s, preferably above 35 Pa·s, and particularly above 40 Pa·s. Non-ionic surfactants that have a wax-like consistency at room temperature are also preferred.

The non-ionic surfactant that is solid at room temperature preferably has propylene oxide (PO) units in the molecule. Preferably, such PO units constitute up to 25 wt. %, especially preferably up to 20 wt. %, and in particular up to 15 wt. % of the total molar mass of the non-ionic surfactant. Especially preferred non-ionic surfactants are ethoxylated monohydroxy alkanols or alkyl phenols that additionally have polyoxyethylene-polyoxypropylene block copolymer units. The alcohol or alkyl phenol fraction of such non-ionic surfactant molecules preferably constitutes more than 30 wt. %, especially preferably more than 50 wt. %, and in particular more than 70 wt. % of the total molar mass of such non-ionic surfactants. Preferred agents are characterized in that they contain ethoxylated and propoxylated non-ionic surfactants in which the propylene oxide units in the molecule constitute up to 25 wt. %, preferably up to 20 wt. %, and in particular up to 15 wt. % of the total molar mass of the non-ionic surfactant.

Additional especially preferred non-ionic surfactants to be used in the first phase having melting points above room temperature contain 40 to 70% of a polyoxypropylene/polyoxyethylene/polyoxypropylene block polymer blend that contains 75 wt. % of a reverse block copolymer of polyoxyethylene and polyoxypropylene with 17 mol ethylene oxide and 44 mol propylene oxide and 25 wt. % of a block copolymer of polyoxyethylene and polyoxypropylene, initiated with trimethylolpropane and containing 24 mol ethylene oxide and 99 mol propylene oxide per mol of trimethylolpropane.

In one preferred embodiment, the proportion by weight of the non-ionic surfactant with respect to the total weight of the first phase is 0.1 to 20 wt. %, especially preferably 0.5 to 15 wt. %, and in particular 2.5 to 10 wt. %.

All anionic surface-active substances are suitable for use as anionic surfactants in dishwashing detergents. These are characterized by a water-solubilizing, anionic group such as a carboxylate, sulfate, sulfonate or phosphate group and a lipophilic alkyl group having approximately 8 to 30 C atoms. In addition, glycol or polyglycol ether groups, ester, ether and amide groups as well as hydroxyl groups can be contained in the molecule. Suitable anionic surfactants are preferably present in the form of the sodium, potassium and ammonium as well as the mono-, di- and trialkanol ammonium salts with 2 to 4 C atoms in the alkanol group, but zinc, manganese(II), magnesium, calcium, or mixtures thereof can also be used as the counterion.

Preferred anionic surfactants are alkyl sulfates, alkyl polyglycol ether sulfates, and ether carboxylic acids with 10 to 18 C atoms in the alkyl group and up to 12 glycol ether groups in the molecule.

Instead of the above-mentioned surfactants or in conjunction with them, cationic and/or amphoteric surfactants such as betaines or quaternary ammonium compounds can also be used. It is preferred, however, that no cationic and/or amphoteric surfactants be used.

Surfactants influence the opacity of the second phase. In a likewise preferred, different embodiment, the second phase is therefore free of surfactants, in particular of non-ionic surfactants.

Preferred detergent or cleaning agents according to the invention are also characterized in that, in the at least one first and/or the at least one second phase, in particular in the first phase, they contain less than 1.0 wt. % and in particular no anionic surfactant, since the addition of anionic surfactants has proven disadvantageous with respect to the phase characteristics, in particular the hardness, friability (wearing behavior), and post-curing behavior.

Substances that are also used as ingredients of cosmetic agents are also designated in the following according to the International Nomenclature of Cosmetic Ingredients (INCI) as appropriate. Chemical compounds have an INCI name in English. The INCI names can be found in the "International Cosmetic Ingredient Dictionary and Handbook, 7th Edition (1997)," which is published by The Cosmetic, Toiletry and Fragrance Association (CTFA), Washington D.C. (USA). The expression CAS means that the following numerical sequence is a designation of the Chemical Abstracts Service.

Besides the surfactants, the at least one second phase can also contain sugars. According to the invention, sugars include sugar alcohols, monosaccharides, disaccharides, and oligosaccharides. In a preferred embodiment, the at least one second phase comprises at least one sugar alcohol, preferably mannitol, isomalt, lactitol, sorbitol, threitol, erythritol, arabitol and xylitol. Xylitol is particularly preferred.

In a further embodiment, the second phase can comprise disaccharides, in particular sucrose. The proportion of sucrose is 0 wt. % to 30 wt. %, in particular 5 wt. % to 25 wt. %, especially preferably 10 wt. % to 20 wt. %, based on the weight of the second phase. In greater quantities, the sugar does not dissolve completely in the second phase and results in the clouding thereof. By using sugar, in particular in a proportion of from 10 wt. % to 15 wt. %, the development of moisture is reduced and the adhesion to the at least one first phase thus improved.

The use of builder substances (builders) such as silicates, aluminum silicates (in particular zeolites), salts of organic di- and polycarboxylic acids, as well as mixtures of these substances, preferably water-soluble builder substances, can be advantageous.

In an embodiment that is preferred according to the invention, the use of phosphates (including polyphosphates) is omitted either largely or completely. In this embodiment, the agent preferably contains less than 5 wt. %, especially preferably less than 3 wt. %, in particular less than 1 wt. % phosphate(s). Especially preferably, the agent in this embodiment is completely phosphate-free, i.e. the agents contain less than 0.1 wt. % phosphate(s).

The builders include, in particular, carbonates, citrates, phosphonates, organic builders, and silicates. The proportion by weight of the total builders with respect to the total weight of agents according to the invention is preferably 15 to 80 wt. % and in particular 20 to 70 wt. %.

Some examples of organic builders that are suitable according to the invention are the polycarboxylic acids (polycarboxylates) that can be used in the form of their sodium salts, with polycarboxylic acids being understood as being those carboxylic acids that carry more than one, in particular two to eight acid functions, preferably two to six, in particular two, three, four, or five acid functions in the entire molecule. As polycarboxylic acids, dicarboxylic acids, tricarboxylic acids, tetracarboxylic acids, and pentacarboxylic acids, particularly di-, tri-, and tetracarboxylic acids, are thus preferred. The polycarboxylic acids can also carry additional functional groups such as hydroxyl or amino groups, for example. For example, these include citric acid, adipic acid, succinic acid, glutaric acid, malic acid, tartaric acid, maleic acid, fumaric acid, sugar acids (preferably aldaric acids, for example galactaric acid and glucaric acid), aminocarboxylic acids, in particular aminodicarboxylic acids, aminotricarboxylic acids, aminotetracarboxylic acids such as, for example, nitrilotriacetic acid (NTA), glutamic-N,N-diacetic acid (also called N,N-bis(carboxymethyl)-L-glutamic acid or GLDA), methyl glycine diacetic acid (MGDA) and derivatives thereof and mixtures thereof. Preferred salts are the salts of the polycarboxylic acids such as citric acid, adipic acid, succinic acid, glutaric acid, tartaric acid, GLDA, MGDA, and mixtures thereof.

Other substances that are suitable as organic builders are polymeric polycarboxylates (organic polymers with a plurality of (in particular greater than ten) carboxylate functions in the macromolecule), polyaspartates, polyacetals, and dextrins.

Besides their building effect, the free acids also typically have the quality of an acidifying component. Particularly noteworthy here are citric acid, succinic acid, glutaric acid, adipic acid, gluconic acid, and any mixtures thereof.

Especially preferred detergents or cleaning agents according to the invention, in particular dishwashing detergents, preferably automatic dishwashing detergents, contain one or more salts of citric acid, i.e. citrates, as one of their essential builders. These are preferably contained in a proportion of from 2 to 40 wt. %, in particular from 5 to 30 wt. %, especially from 7 to 28 wt. %, especially preferably from 10 to 25 wt. %, very especially preferably from 15 to 20 wt. %, in each case based on the total weight of the agent.

It is also especially preferred to use carbonate(s) and/or hydrogen carbonate(s), preferably alkali carbonate(s), especially preferably sodium carbonate (soda), in amounts of from 2 to 50 wt. %, preferably from 4 to 40 wt. %, and in particular from 10 to 30 wt. %, very especially preferably from 10 to 24 wt. %, in each case based on the weight of the agent.

Especially preferred detergents or cleaning agents according to the invention, in particular dishwashing detergents, preferably automatic dishwashing detergents, are characterized in that they contain at least two builders from the group of silicates, phosphonates, carbonates, aminocarboxylic acids, and citrates, with the proportion by weight of these builders based on the total weight of the cleaning agent according to the invention being preferably 5 to 70 wt. %, more preferably 15 to 60 wt. %, and in particular 20 to 50 wt. %. The combination of two or more builders from the above-mentioned group has proven advantageous for the cleaning and rinsing performance of detergents or cleaning agents according to the invention, in particular dishwashing detergents, preferably automatic dishwashing detergents. Beyond the builders mentioned here, one or more other builders can be additionally contained.

Preferred detergents or cleaning agents, in particular dishwashing detergents, preferably automatic dishwashing detergents, are characterized by a builder combination of citrate and carbonate and/or hydrogen carbonate. In one embodiment that is very especially preferred according to the invention, a mixture of carbonate and citrate is used in which the amount of carbonate is preferably 5 to 40 wt. %, in particular 10 to 35 wt. %, very particularly preferably 15 to 30 wt. %, and the amount of citrate is preferably 5 to 35 wt. %, in particular 10 to 25 wt. %, very particularly preferably 15 to 20 wt. %, in each case based on the total amount of the cleaning agent, with the total amount of these two builders preferably being 20 to 65 wt. %, in particular 25 to 60 wt. %, preferably 30 to 50 wt. %. Moreover, one or more other builders can be additionally contained.

The detergents or cleaning agents according to the invention, in particular dishwashing detergents, preferably automatic dishwashing detergents, can contain phosphonates in particular as an additional builder. A hydroxy alkane and/or amino alkane phosphonate is preferably used as a phosphonate compound. Among the hydroxy alkane phosphonates, 1-hydroxyethane-1,1-diphosphonate (HEDP) has particular significance. Possible preferable aminoalkane phosphonates include ethylenediamine tetramethylene phosphonate (EDTMP), diethylentriamine pentamethylene phosphonate (DTPMP) and the higher homologues thereof. Phosphonates are preferably contained in agents according to the invention in amounts of from 0.1 to 10 wt. %, in particular in amounts of from 0.5 to 8 wt. %, very especially preferably from 2.5 to 7.5 wt. %, in each case based on the total weight of the agent.

The combined use of citrate, (hydrogen) carbonate, and phosphonate is especially preferred. These can be used in the above-mentioned amounts. In particular, amounts of 10 to 25 wt. % citrate, 10 to 30 wt. % carbonate (or hydrogen carbonate), and 2.5 to 7.5 wt. % phosphonate are used in this combination, in each case based on the total weight of the agent.

Additional especially preferred detergents or cleaning agents, in particular dishwashing detergents, preferably automatic dishwashing detergents, are characterized in that, in addition to citrate and (hydrogen) carbonate and, optionally, phosphonate, they contain at least one additional phosphorous-free builder. In particular, it is selected from aminocarboxylic acids, with the additional phosphorous-free builder preferably being selected from methyl glycine diacetic acid (MGDA), glutamic acid diacetate (GLDA), aspartic acid diacetate (ASDA), hydroxyethyliminodiacetate (HEIDA), iminodisuccinate (IDS), and ethylenediamine disuccinate (EDDS), especially preferably from MGDA or GLDA. An example of an especially preferred combination is citrate, (hydrogen) carbonate, and MGDA as well as, optionally, phosphonate.

The proportion by weight of the additional phosphorous-free builder, in particular of the MGDA and/or GLDA, is preferably 0 to 40 wt. %, in particular 5 to 30 wt. %, especially 7 to 25 wt. %. The use of MGDA or GLDA, in particular MGDA, as granular material is especially preferred. Advantageous in this regard are MGDA granules that contain as little water as possible and/or have a lower hygroscopicity (water absorption at 25° C., normal pressure) than non-granulated powders. The combination of at least three, in particular at least four, builders from the above-mentioned group has proven advantageous for the cleaning and rinsing performance of cleaning agents according to the invention, in particular dishwashing detergents, preferably automatic dishwashing detergents. Besides those, additional builders can also be contained.

Polymeric polycarboxylates are also suitable as organic builders. These are, for example, the alkali metal salts of polyacrylic acid or polymethacrylic acid, for example those having a relative molecular mass of from 500 to 70,000 g/mol. Suitable polymers are in particular polyacrylates which preferably have a molecular mass of from 1,000 to 20,000 g/mol. Due to their superior solubility, the short-chain polyacrylates, which have molar masses from 1,100 to 10,000 g/mol, and especially preferably from 1,200 to 5,000 g/mol, can be preferred from this group.

The (homo)polymeric polycarboxylates contained in the detergents or cleaning agents according to the invention, in particular dishwashing detergents, preferably automatic dishwashing detergents, amount to preferably 0.5 to 20 wt. %, more preferably 2 to 15 wt. %, and in particular 4 to 10 wt. %.

Detergents or cleaning agents according to the invention, in particular dishwashing detergents, preferably automatic dishwashing detergents, can also contain, as a builder, crystalline layered silicates of general formula $NaMSi_x O_{2x+1}.y\ H_2O$, where M represents sodium or hydrogen, x is a number from 1.9 to 22, preferably from 1.9 to 4, with 2, 3, or 4 being especially preferred values for x, and y represents a number from 0 to 33, preferably from 0 to 20. It is also possible to use amorphous sodium silicates with a module $Na_2O:SiO_2$ modulus of 1:2 to 1:3.3, preferably 1:2 to 1:2.8, and particularly 1:2 to 1:2.6 can also be used which preferably have retarded dissolution and secondary washing properties.

In certain detergents or cleaning agents according to the invention, in particular dishwashing detergents, preferably automatic dishwashing detergents, the silicate content, based on the total weight of the detergent or cleaning agent, is limited to amounts below 10 wt. %, preferably below 5 wt. %, and in particular below 2 wt. %.

In addition to the aforementioned builders, the detergents or cleaning agents according to the invention can also contain alkali metal hydroxides. These alkali carriers are preferably used in the detergents or cleaning agents and in particular in the at least one second phase only in small amounts, preferably in amounts below 10 wt. %, preferably below 6 wt. %, more preferably below 5 wt. %, especially preferably between 0.1 and 5 wt. %, and in particular between 0.5 and 5 wt. %, in each case based on the total weight of the detergent or cleaning agent. Alternative detergents or cleaning agents according to the invention are free of alkali metal hydroxides.

As an additional component, cleaning agents according to the invention preferably contain enzyme(s) in the at least one first and/or the at least one second phase. These include, in particular, proteases, amylases, lipases, hemicellulases, cellulases, perhydrolases, or oxidoreductases, as well as, preferably, mixtures thereof. Said enzymes are in principle of natural origin; proceeding from the natural molecules, improved variants for use in cleaning agents are available which are preferably used accordingly.

Cleaning agents according to the invention preferably contain enzymes in total amounts of from $1\times10^{-6}$ wt. % to 5 wt. % based on active protein. The protein concentration can be determined with the aid of known methods, for example the BCA method or the Biuret method.

Among the proteases, the subtilisin-type proteases are preferred. Examples of these are the subtilisins BPN' and Carlsberg, as well as the further developed forms thereof, protease PB92, subtilisins 147 and 309, the alkaline protease from *Bacillus lentus*, subtilisin DY, and the enzymes thermitase, proteinase K and proteases TW3 and TW7, which belong to the subtilases but no longer to the subtilisins in the narrower sense.

Examples of amylases that can be used according to the invention are α-amylases from *Bacillus licheniformis*, from *B. amyloliquefaciens*, from *B. stearothermophilus*, from *Aspergillus niger*, and *A. oryzae*, as well as the further developments of said amylases that have been improved for use in cleaning agents. Others that are particularly noteworthy for this purpose are the α-amylases from *Bacillus* sp. A 7-7 (DSM 12368) and cyclodextrin glucanotransferase (CGTase) from *B. agaradherens* (DSM 9948).

Furthermore, lipases or cutinases can be used according to the invention, in particular due to their triglyceride-cleaving activities, but also in order to produce peracids in situ from suitable precursors. These include, for example, the lipases that could originally be obtained from Humicola lanuginosa (Thermomyces lanuginosus) and those that have been further developed, particularly those with the amino acid exchange in positions D96LT213R and/or N233R, especially preferably all of the exchanges D96L, T213R, and N233R.

Moreover, enzymes can be used which can be grouped together under the term "hemicellulases". These include, for example, mannanases, xanthan lyases, pectin lyases (=pectinases), pectinesterases, pectate lyases, xyloglucanases (=xylases), pullulanases, and β-glucanases.

In order to increase the bleaching effect, oxidoreductases such as oxidases, oxygenases, catalases, peroxidases such as halo-, chloro-, bromo-, lignin, glucose, or manganese peroxidases, dioxygenases or laccases (phenoloxidases, polyphenoloxidases) can be used according to the invention. Advantageously, organic, particularly preferably aromatic compounds that interact with the enzymes are additionally added in order to potentiate the activity of the relevant oxidoreductases (enhancers) or, in the event of greatly differing redox potentials, to ensure the flow of electrons between the oxidizing enzymes and the contaminants (mediators). A protein and/or enzyme can be protected, especially during storage, against damage such as inactivation, denaturing, or decomposition caused for example by physical influences, oxidation or proteolytic cleavage. When the proteins and/or enzymes are obtained microbially, it is especially preferable for proteolysis to be inhibited, particularly if the agents also contain proteases. Cleaning agents may contain stabilizers for this purpose; the provision of such agents constitutes a preferred embodiment of the present invention.

Cleaning-active proteases and amylases are generally not made available in the form of the pure protein, but rather in the form of stabilized, storable and transportable preparations. These ready-made preparations include, for example, the solid preparations obtained through granulation, extrusion, or lyophilization or, particularly in the case of liquid or gel-type agents, solutions of the enzymes, advantageously maximally concentrated, having little water, and/or supplemented with stabilizers or other auxiliaries.

Alternatively the enzymes can also be encapsulated for the at least one first and/or the at least one second phase, for example by spray-drying or extrusion of the enzyme solution together with a preferably natural polymer or in the form of capsules, for example those in which the enzymes are enclosed in a set gel, or in those of the core-shell type in which an enzyme-containing core is coated with a water-, air-, and/or chemical-impermeable protective layer. In the case of overlaid layers, other active ingredients, such as stabilizers, emulsifiers, pigments, bleaching agents, or dyes, can be additionally applied. Such capsules are applied using inherently known methods, for example by shaking or roll granulation or in fluidized bed processes. Such granules are advantageously low in dust, for example due to the application of polymeric film-formers, and stable in storage due to the coating.

Moreover, it is possible to formulate two or more enzymes together, so that a single granule exhibits a plurality of enzyme activities.

As is clear from the preceding remarks, the enzyme protein forms only a fraction of the total weight of conventional enzyme preparations. Protease and amylase preparations that are used according to the invention contain between 0.1 and 40 wt. %, preferably between 0.2 and 30 wt. %, especially preferably between 0.4 and 20 wt. %, and in particular between 0.8 and 10 wt. % of the enzyme protein. In particular, those cleaning agents are preferred which contain, based on their total weight, 0.1 to 12 wt. %, preferably 0.2 to 10 wt. %, and in particular 0.5 to 8 wt. % of the respective enzyme preparations.

Besides the components cited above, the at least one first and/or the at least one second phase of the detergent or cleaning agent according to the invention can contain additional ingredients. For example, these include anionic, cationic, and/or amphoteric surfactants, bleaching agents, bleach activators, bleach catalysts, other solvents, thickeners, sequestering agents, electrolytes, corrosion inhibitors, in particular silver protection agents, glass corrosion inhibitors, foam inhibitors, dyes, fragrances (particularly in the at least one first phase), additives for improving the flow and drying behavior, for adjusting the viscosity, for stabilization, UV stabilizers, pearlescing agents (INCI Opacifying Agents; for example, glycol distearate, such as Cutina® AGS by Cognis, or mixtures containing same, such as Euperlane® by Cognis), preservatives (for example, the technical preservative 2-bromo-2-nitropropane-1,3-diol, which is also known as Bronopol (CAS 52-51-7) and is commercially available as Myacide® BT or as Boots Bronopol BT from the Boots company), antimicrobial active ingredients (disinfectants), and pH adjusters in amounts of usually no more than 5 wt. %.

Agents according to the invention preferably contain at least one alkanolamine as an additional solvent. The alkanolamine is preferably selected from the group consisting of mono-, di-, triethanol- and propanolamine and mixtures thereof. The alkanolamine is preferably contained in agents according to the invention in an amount of from 0.5 to 10 wt. %, in particular in an amount of from 1 to 6 wt. %. In a preferred detergent or cleaning agent, the at least one second phase is free of alkanolamine, and the alkanolamine is contained only in the at least one first phase.

In a preferred embodiment, detergents or cleaning agents according to the invention, in particular dishwashing detergents, contain, as an additional component, at least one zinc salt as a glass corrosion inhibitor. The zinc salt can be an inorganic or organic zinc salt. The zinc salt to be used according to the invention preferably has a solubility in water of greater than 100 mg/l, preferably greater than 500 mg/l, especially preferably greater than 1 g/l, and particularly greater than 5 g/l (all solubilities at 20° C. water temperature).

The inorganic zinc salt is preferably selected from the group consisting of zinc bromide, zinc chloride, zinc iodide, zinc nitrate, and zinc sulfate. The organic zinc salt is preferably selected from the group consisting of zinc salts of monomeric or polymeric organic acids, particularly from the group of zinc acetate, zinc acetyl acetonate, zinc benzoate, zinc formate, zinc lactate, zinc gluconate, zinc ricinoleate, zinc abietate, zinc valerate, and zinc-p-toluene sulfonate. In an embodiment that is especially preferred according to the invention, zinc acetate is used as a zinc salt. The zinc salt is preferably contained in cleaning agents according to the invention in an amount of from 0.01 wt. % to 5 wt. %, especially preferably in an amount of from 0.05 wt. % to 3 wt. %, in particular in an amount of from 0.1 wt. % to 2 wt. %, based on the total weight of the cleaning agent. In addition or alternatively to the above-mentioned salts (particularly the zinc salts), polyethyleneimines such as those which are available under the name Lupasol® (BASF) are preferably used as glass corrosion inhibitors in an amount of from 0 to 5 wt. %, in particular 0.01 to 2 wt. %.

Polymers that are suitable as additives are in particular maleic acid acrylic acid copolymer Na salt (for example, Sokalan® CP 5 by BASF, Ludwigshafen (Germany)), modified polyacrylic acid Na salt (for example, Sokalan® CP 10 by BASF, Ludwigshafen (Germany)), modified polycarboxylate Na salt (for example, Sokalan® HP 25 by BASF, Ludwigshafen (Germany)), polyalkylene oxide, modified heptamethyltrisiloxane (for example, Silwet® L-77 by BASF, Ludwigshafen (Germany)), polyalkylene oxide, modified heptamethyltrisiloxane (for example, Silwet® L-7608 by BASF, Ludwigshafen (Germany)), as well as polyethersiloxane (copolymers of polymethyl siloxanes with ethylene oxide/propylene oxide segments (polyether blocks)), preferably water-soluble, linear polyether siloxanes with terminal polyether blocks, such as Tegopren® 5840, Tegopren® 5843, Tegopren® 5847, Tegopren® 5851, Tegopren® 5863, or Tegopren® 5878 by Evonik, Essen (Germany). Builder substances that are suitable as additives are particularly polyaspartic acid Na salt, ethylenediamine triacetate cocoalkyl acetamide (for example, Rewopol® CHT 12 by Evonik, Essen (Germany)), methyl glycine diacetic acid tri-Na salt, and acetophosphonic acid. In the case of Tegopren® 5843 and Tegopren® 5863, mixtures with surface-active or polymeric additives exhibit synergisms. However, the use of Tegopren types 5843 and 5863 on hard surfaces made of glass, in particular glass dishes, is less preferred, since these silicone surfactants can adhere to glass. In a particular embodiment of the invention, the above-mentioned additives are omitted.

A preferred detergent or cleaning agent, in particular dishwashing detergent, preferably also comprises a bleaching agent, in particular an oxygen bleaching agent, as well as, optionally, a bleach activator and/or bleach catalyst. Insofar as they are present, they are contained exclusively in the at least one first phase.

As a preferred bleaching agent, cleaning agents according to the invention contain an oxygen bleaching agent from the group of sodium percarbonate, sodium perborate tetrahydrate, and sodium perborate monohydrate. Further examples of bleaching agents which may be used are peroxypyrophosphates, citrate perhydrates as well as $H_2O_2$-yielding peracid salts or peracids, such as perbenzoates, peroxophthalates, diperazelaic acid, phthaloiminoperacid or diperdodecane diacid. Moreover, bleaching agents from the group of the organic bleaching agents can also be used. Typical organic bleaching agents are the diacyl peroxides, such as dibenzoyl peroxide. Other typical organic bleaching agents are the peroxy acids, with the alkylperoxy acids and the arylperoxy acids meriting special mention as examples. Due to its good bleaching performance, sodium percarbonate is especially preferred. One especially preferred oxygen bleaching agent is sodium percarbonate.

Compounds which, under perhydrolysis conditions, result in aliphatic peroxocarboxylic acids having preferably 1 to 10 C atoms, in particular 2 to 4 C atoms, and/or optionally substituted perbenzoic acid, may be used as bleach activators. Substances that carry the 0- and/or N-acyl groups of the stated number of C atoms and/or optionally substituted benzoyl groups are suitable. Multiply acylated alkylene diamines are preferred, with tetraacetylethyl ethylenediamine (TAED) having proven to be especially suitable.

The bleach catalysts are bleach-boosting transition metal salts or transition metal complexes such as, for example, Mn-, Fe-, Co-, Ru-, or Mo-salene complexes or -carbonyl complexes. Mn-, Fe-, Co-, Ru-, Mo-, Ti-, V-, and Cu-complexes with N-containing tripod ligands as well as Co-, Fe- Cu-, and Ru-ammine complexes can also be used as bleach catalysts. Complexes of manganese in oxidation stage II, III, IV, or IV are especially preferably used which preferably contain one or more macrocyclic ligands with the donor functions N, NR, PR, O and/or S.

Preferably, ligands are used which have nitrogen donor functions. It is especially preferred to use bleach catalyst(s) in the agents according to the invention which contains or contain, as macromolecular ligands, 1,4,7-trimethyl-1,4,7-triazacyclononane (Me-TACN), 1,4,7-triazacyclononane (TACN), 1,5,9-trimethyl-1,5,9-triazacyclododecane (Me-TACD), 2-methyl-1-1,4,7-trimethyl-1,4,7-triazacyclononane (Me/Me-TACN), and/or 2-methyl-1,4,7-triazacyclononane (Me/TACN). Suitable manganese complexes are, for example, $[Mn^{III}{}_2(\mu\text{-}O)_1(\mu\text{-}OAc)_2(TACN)_2](ClO_4)_2$, $[Mn^{III}Mn^{IV}(\mu\text{-}O)_2(\mu\text{-}OAc)_1(TACN)_2](BPh_4)_2$, $[Mn^{IV}{}_4(\mu\text{-}O)_6(TACN)_4](ClO_4)_4$, $[Mn^{III}{}_2(\mu\text{-}O)_1(\mu\text{-}OAc)_2(Me\text{-}TACN)_2](ClO_4)_2$, $[Mn^{III}Mn^{IV}(\mu\text{-}O)_1(\mu\text{-}OAc)_2(Me\text{-}TACN)_2](ClO_4)_3$, $[Mn^{IV}{}_2(\mu\text{-}O)_3(Me\text{-}TACN)_2](PF_6)_2$ and $[Mn^{IV}{}_2(\mu\text{-}O)_3(Me/Me\text{-}TACN)_2](PF_6)_2$(where OAc=OC(O)$CH_3$).

When benzoic acid, salicylic acid, or lactic acid are used as pH regulators and/or buffer substances, these compounds can support or potentiate the antibacterial effect of the silver and/or of the silver compound.

The detergent or cleaning agent according to the invention comprises at least one first phase and at least one second phase. The detergent or cleaning agent can thus have one, two, three, or more different first phases; it may also have one, two, three or more different second phases. Preferably, the detergent or cleaning agent according to the invention comprises one first phase and one second phase. Especially preferably, the detergent or cleaning agent comprises two first phases and one second phase. Preferably, it comprises two first phases and two second phases. An embodiment is also preferred in which the detergent or cleaning agent comprises three first phases and one or two second phases.

In this case, the weight ratio of the entirety of the at least one first phase to the entirety of the at least one second phase is usually 40:1 to 2:1, in particular 20:1 to 4:1, preferably 12:1 to 6:1, for example 10:1 to 8:1. The total weight of all the phases in a cleaning agent portion can be between 8 and 30 g, in particular 10 to 25 g, preferably 12 to 21 g, for example 14 to 16 g per detergent or cleaning agent portion. This weight ratio provides a good concentration of the respective ingredients of the first and second phase in a cleaning process.

According to the invention, the at least one first phase and the at least one second phase are adjacent to one another over all or part of their surfaces. It is preferred in this regard that the two phases be immediately adjacent.

If the at least one first phase and the at least one second phase are immediately adjacent to one another over all or part of their surfaces, stability is important, as is a setting time of the at least one second phase that is as short as possible. Here, stability means that components contained in the second phase do not cross over into the at least one first phase, but rather the at least one first phase and the at least one second phase remain visually separate from one another even after a long period of storage and do not interact with each other, for example by the diffusion of liquid components from one phase to the other or the reaction of components of one phase with those in the other phase. Surprisingly, it was found that this can be made possible by a second phase that comprises glycerin, gelatin and at least one $C_3$ to $C_5$ alkanediol, or glycerin, PVOH and at least one $C_3$ to $C_5$ alkanediol.

According to a particularly preferred embodiment, the detergent or cleaning agents according to the invention are characterized in that the at least one second phase comprises less than 1 wt. %, in particular less than 0.5 wt. %, in particular less than 0.1 wt. %, anionic surfactant, in each case based on the total weight of the second phase.

The at least one second phase is preferably substantially free of anionic surfactants. Substantially free means that the at least one second phase comprises less than 0.05 wt. % anionic surfactant, in each case based on the total weight of the second phase.

It has been found in this context that the presence of 1 wt. % anionic surfactant in the at least one second phase leads to poorer foaming behavior and poorer rinsing behavior of the overall composition. Furthermore, higher amounts of anionic surfactants adversely affect the curing.

Water-Soluble Wrapping

The water-soluble wrapping is preferably made from a water-soluble film material, which is selected from the group consisting of polymers or polymer mixtures. The wrapping may be made up of one or of two or more layers of the water-soluble film material. The water-soluble film material of the first layer and of the additional layers, if present, may be the same or different.

It is preferable for the water-soluble wrapping to contain polyvinyl alcohol or a polyvinyl alcohol copolymer. Water-soluble wrappings containing polyvinyl alcohol or a polyvinyl alcohol copolymer exhibit good stability with a sufficiently high level of water solubility, in particular cold-water solubility.

Suitable water-soluble films for producing the water-soluble wrapping are preferably based on a polyvinyl alcohol or a polyvinyl alcohol copolymer of which the molecular weight is in the range of from 10,000 to 1,000,000 $gmol^{-1}$, preferably 20,000 to 500,000 $gmol^{-1}$, particularly preferably 30,000 to 100,000 $gmol^{-1}$ and in particular 40,000 to 80,000 $gmol^{-1}$.

Polyvinyl alcohol is usually produced by hydrolysis of polyvinyl acetate, since the direct synthesis route is not possible. The same applies to polyvinyl alcohol copolymers, which are produced accordingly from polyvinyl acetate copolymers. It is preferable for at least one layer of the water-soluble wrapping to include a polyvinyl alcohol of which the degree of hydrolysis is 70 to 100 mol. %, preferably 80 to 90 mol. %, particularly preferably 81 to 89 mol. %, and in particular 82 to 88 mol. %.

In a preferred embodiment, the water-soluble packaging consists of at least 20 wt. %, especially preferably at least 40 wt. %, very especially preferably at least 60 wt. %, and in particular at least 80 wt. % of a polyvinyl alcohol of which the degree of hydrolysis is 70 to 100 mol. %, preferably 80 to 90 mol. %, especially preferably 81 to 89 mol. %, and in particular 82 to 88 mol. %.

In addition, a polymer selected from the group including (meth)acrylic acid-containing (co)polymers, polyacrylamides, oxazoline polymers, polystyrene sulfonates, polyurethanes, polyesters, polyethers, polylactic acid or mixtures of said polymers may be added to a polyvinyl alcohol-containing film material that is suitable for producing the water-soluble wrapping. Polylactic acids are a preferred additional polymer.

Preferred polyvinyl alcohol copolymers include, in addition to vinyl alcohol, dicarboxylic acids as further monomers. Suitable dicarboxylic acids are itaconic acid, malonic acid, succinic acid and mixtures thereof, with itaconic acid being preferred. Polyvinyl alcohol copolymers which include, in addition to vinyl alcohol, an ethylenically unsaturated carboxylic acid, or the salt or ester thereof, are also preferred. Polyvinyl alcohol copolymers of this kind particularly preferably contain, in addition to vinyl alcohol, acrylic acid, methacrylic acid, acrylic acid ester, methacrylic acid ester or mixtures thereof.

It may be preferable for the film material to contain further additives. The film material may contain plasticizers such as dipropylene glycol, ethylene glycol, diethylene glycol, propylene glycol, glycerin, sorbitol, mannitol or mixtures thereof, for example. Further additives include for example release aids, fillers, cross-linking agents, surfactants, anti-oxidants, UV absorbers, anti-blocking agents, anti-adhesive agents or mixtures thereof.

Suitable water-soluble films for use in the water-soluble wrappings of the water-soluble packaging according to the invention are films which are sold by MonoSol LLC, for example under the names M8720, M8630, M8312, M8440, M7062, C8400 or M8900. Films which are sold under the names SH2601, SH2504, SH2707 or SH2701 by Nippon Gohsei are also suitable. Other suitable films include films having the designations Solublon® PT, Solublon® GA, Solublon® KC or Solublon® KL from Aicello Chemical Europe GmbH, or the VF-HP films from Kuraray.

The water-soluble wrapping preferably has, at least in part, a bitter principle having a bitter value of between 1,000 and 200,000, especially those selected from quinine sulfate (bitter value=10,000), naringin (bitter value=10,000), sucrose octaacetate (bitter value=100,000), quinine hydrochloride and mixtures thereof. In particular, the outer surface of the water-soluble wrapping is coated at least in part with a bitter principle having a bitter value of between 1,000 and 200,000. In this connection, it is particularly preferable for the water-soluble wrapping to be coated by at least 50%, preferably at least 75%, and very particularly preferably at least 90%, with the bitter principle having a bitter value of between 1,000 and 200,000. The application of the bitter principle having a bitter value of between 1,000 and 200,000 can take place for example by means of printing, spraying or spreading.

According to the invention, the water-soluble wrapping has at least one continuous peripheral sealing seam that lies substantially in one plane. This is favorable from a procedural point of view since only a single sealing step, possibly using only a single sealing tool, is required for a circumferential sealing seam that lies substantially in one plane. The continuous circumferential sealing seam leads to better closure compared with those wrappings having a plurality of sealing seams and to excellent sealing of the sealed seam and thus of the wrapping itself. Leakage of product out of the wrapping, e.g. on the surface of the portion, would be detrimental as the consumer would then come into contact with the product. Precisely this situation should be avoided as far as possible with a detergent or cleaning agent portion comprising a water-soluble wrapping.

The water-soluble wrapping may preferably be produced from at least two packaging parts. Preferably, the at least two packaging parts are water-soluble, so that no packaging parts remain in the dishwasher, which can then lead to problems in the dishwasher. The at least two packaging parts do not have to be different. They may preferably be produced from the same material and in the same way. In a preferred embodiment, these are two parts of a water-soluble film, in particular two parts of a water-soluble film of the same composition.

In a further embodiment, the at least two packaging parts can be made of different materials, e.g. of different films or of material having two different properties (e.g. film that is soluble in hot and cold water). In this embodiment, it is preferable for a water-soluble film and another packaging part made by injection molding to be combined.

According to a particularly preferred embodiment of the present invention, the water-soluble wrapping comprises at least one at least partly plastically deformed film.

In particular, this plastic deformation of the film can be produced by methods known to a person skilled in the art, such as deep-drawing (with and without application of a vacuum), blowing or stamping. In particular, the water-soluble wrapping comprises at least one at least partly plastically deformed film which has been produced by deep-drawing.

The at least one first phase and the at least one second phase can be arranged within the water-soluble wrapping in any desired combination with respect to one another. For instance, a first phase may be arranged on or beside a second phase. In this embodiment, the detergent or cleaning agent according to the invention comprises one first phase and one second phase.

It is also conceivable for a first phase to be surrounded by second phases. Embedding one phase into another is also covered according to the invention. In a further, particularly preferred arrangement, the second phase is in cast form, for example in the form of a gel core, and is surrounded by the first phase. Two or more cavities that are separated from one another can also be present which are filled with the at least one second phase. In this embodiment, the detergent or cleaning agent comprises two second phases, it being possible for the two second phases to have different compositions.

According to a preferred embodiment, three, four, five or six or more cavities that are separated from one another are present which are filled with one or more of the second phases. Preferably, those detergents or cleaning agents comprise three, four, five or six or more second phases, it being possible for said second phases to have the same or different compositions.

The present invention further relates to a method for producing detergent and/or cleaning agent portion packs, in particular cleaning agent portion packs, that contain a product comprising at least one first phase and at least one second phase different therefrom, the method comprising:

a) providing a mold having at least one mold cavity; optionally containing a partition for dividing the base of the mold cavity;
b) adding a water-soluble film onto the mold cavity;
c) forming an open chamber in the mold cavity by deforming the water-soluble film;
d) filling the open chamber or parts thereof with at least one second phase as described above;
e) optionally filling the open chamber or parts thereof with at least one further second phase as described above, it being possible for said second phase to optionally differ from the second phase according to d);
f) optionally leaving the second phase(s) to set;
g) subsequently filling the open chamber with at least one first phase that is different from the at least one second phase as described above;
h) providing a second water-soluble film as a cover;
i) superimposing the open chamber and the cover in order to seal the portion pack at a sealing region;
j) sealing the cover with the open chamber.

The product is preferably a dishwashing detergent, preferably an automatic dishwashing detergent.

The mold comprises at least one cavity (mold cavity). For example, the mold may be provided as a single mold or as part of an array of molds in the form of a conveyor belt, as is known from the conveyor belt method and from the drum method. The mold comprises a region on which the film can be placed, e.g. a seal region which is typically defined around the opening in a mold cavity. The mold cavity can have different geometries; if there are edges, it is advantageous for them to be rounded. Rounded edges and/or dome-shaped cavities are designed to ensure that the film is pulled somewhat more homogeneously upon being pulled into the cavity, thereby keeping the film thickness uniform in this respect, and that no breakage or tear points are produced, which in turn results in a more stable portion pack.

Optionally, but according to a particular embodiment preferably, the mold contains at least one mold cavity which has a partition for dividing the base of the mold cavity. As a result, bulges or pockets form in the molded chamber, which visually create a positive appearance. In particular, if only the regions of these bulges are completely or partially, preferably almost completely, filled with the second phase(s), this region is again clearly separated from the granular mixture, in particular the powdered first phase, and produces a visually very good appearance.

The water-soluble film can be fed from a roll and onto the mold cavity. The film is positioned and held in place on the mold. The film can be held in place by means of suction holes on the mold surface, which is not part of the mold cavity. However, the film can also be held on the mold by mechanical means, for example clips. For example, the film may be held in place by a stamp which presses on the seal region. In continuous production methods, e.g. drum methods and conveyor belt methods, it is preferable for the speed of the film to be matched to the speed of the conveyor belt formed from the molds, such that the film is not unnecessarily pulled thinner on account of being held in place on a running mold.

After the film is held in place relative to the mold cavity, a chamber is formed in the mold cavity region by adapting the film at least in part to the mold cavity. The film is adapted by means of elastic and/or plastic deformation. Preferably, the film deformation has a greater plastic than elastic proportion. The deformation of the water-soluble film is produced for example by deep-drawing or by means of a suitable stamp. A preferred variant is deep-drawing, by applying negative pressure (forming pressure) in the mold cavity; for this purpose, the mold cavity preferably comprises small openings, preferably in the bottom region, which are connected in terms of air pressure to a vacuum pump by means of corresponding lines.

After forming the open chamber, said chamber or parts thereof are filled in step d) with the at least one second phase of the product. As soon as the at least one second phase has set, if necessary after an additional period of time required for setting, further product constituents (further second phases according to optional step e) or at least one first phase according to step g)) can then be introduced into the chamber. In this case, the at least one first phase according to step g) is a first phase comprising a granular mixture of a solid composition, in particular a first phase that is powdered, preferably powdered and free-flowing.

It is preferable in the above-mentioned production method for the chamber containing the second phase to not be completely filled with the second phase(s) (in step d). In this case, the chamber may preferably be filled with the second phase(s) only in part, preferably only in the lower region or only in the region or just above the region of the bulges or pockets of the chamber formed by the optional partition according to a).

If the chamber or parts thereof is filled with at least two second phases, it is preferred according to a particular embodiment that these second phases are substantially the same or differ only slightly, for example by a different dye. The phases preferably have a very similar, in particular the same, composition with regard to the active substances used (apart from auxiliaries such as dyes). This avoids in particular migration phenomena between the second phases and thus a non-advantageous visual impression during storage on account of inflated or shrunken phases, for example.

When filling with product, the deformed film is preferably still held in the cavity during filling. For example, when negative pressure is applied, the negative pressure is broken only after sealing. In this case, the negative pressure after forming the chamber, in relation to the forming pressure, may have a lower strength (higher pressure), which fulfills only the holding function.

The chamber is filled by introducing at least one first and at least one second phase, in particular by those described above as being in accordance with the invention.

It is important for the seal region to remain free of product. For example, if the chamber is at least partly elastically deformed, this elastic deformation, after filling and prior to sealing, should not be such that the product flows over and out of the open chamber and thus contaminates the seal region.

According to a particular embodiment, the cover is positioned on the open chamber such that in the next step the cover can be placed on the sealing region. The position of the cover is generally determined relative to the position of the chamber. If the chamber moves together with a movable mold on a conveyor belt, the cover has to move in the same way so that the position relative to the chamber remains the same.

The cover is then placed on to the open chamber, which is closed in this way. The contact between the cover and the film in the sealing region thus closes the chamber.

A preferred embodiment of the seal is a material fusion between the film and the cover, for example by solvating the film before applying the cover, or by melting the film and/or cover in the sealing region. Alternatively, the sealing is carried out by gluing or welding.

The positioning, applying, and sealing can take place either in separate steps or simultaneously.

The mold can also comprise at least one second mold cavity such that at least two open chambers are produced by method steps a) to d). The at least two chambers are formed in the same plane. It is preferable, in method step h), for the cover to be positioned over the at least two open chambers and, in method step i), for the cover to be placed on at least the two chambers in order to seal the portion pack at a sealing region. Since the at least two chambers are connected to the same cover, the chambers remain in a particular position relative to one another, in contrast with the prior art, in which adjacent chambers are connected by means of the partition that is formed by the thin films of the packages.

It is particularly preferable for the cover to be provided as part of a strip, by feeding/transferring a strip that comprises at least one cover. Separating the cover may take place prior to positioning, after positioning but before being placed on, while being placed on, or after being placed onto the chamber.

When separated before positioning, the cover is preferably punched out.

The cover and the film may also be separated simultaneously with the sealing. The device which produces the seal by melting consists of at least two parts: one is the mold itself and the other part is a counter-stamp which presses on the mold from the cover side. It is preferred that, in the sealing step, the pressure exerted during sealing at the sealing region by the mold and a further part must be lower than the pressure exerted in the separation region. The separation region surrounds the sealing region.

In the case of separation after sealing, the cover and film are alternatively preferably separated from the strip in the same step, and thus the portion packs are separated.

As an alternative, equally preferred method for producing cleaning agent portion packs according to the invention, the following is suitable in particular. This method comprises the following steps:

a) providing a mold having at least one mold cavity; optionally containing a partition for dividing the base of the mold cavity;
b) adding a water-soluble film onto the mold cavity;
c) forming an open chamber in the mold cavity by deforming the water-soluble film;
d) filling the open chamber with at least one first phase comprising a granular mixture of a solid composition, in particular at least one first powdered phase;
e) providing a second mold having at least one second mold cavity; optionally containing a partition for dividing the base of the mold cavity;
f) adding a second water-soluble film onto the second mold cavity;
g) forming a second open chamber in the second mold cavity by deforming the water-soluble film;
h) filling the second open chamber or parts thereof with at least one second phase as described above;
i) optionally filling the second open chamber or parts thereof from step h) with at least one further second phase as described above, this at least one further second phase being optionally different from the second phase according to h);
j) optionally leaving the second phase(s) to set;
k) superimposing the two open chambers in order to seal the portion pack at a sealing region, the filled regions facing one another;
l) sealing the open chambers together.

Unless otherwise stated, that which was described for the first method also applies to this method.

In this second method, two different chambers are formed, with one chamber containing at least one first phase and the other chamber containing at least one second phase.

Preferably, in step k), the chamber containing the at least one first, in particular powdered and free-flowing phase is arranged such that the granular mixture or powder does not fall out.

In this case, the chamber containing the at least one second phase is then preferably arranged over/above the chamber containing the at least one first phase. In this case, the filled chamber regions face one another. It is important that the at least one second phase in step k) is already set or gel-like or no longer flowable at room temperature, in particular is set or is no longer flowable such that it does not run out of the chamber. After sealing, this results in a multi-phase single-chamber pouch, which has a particularly good appearance.

For both above-mentioned production methods, the following preferably applies:

For the at least one first phase comprising granular mixtures of a solid composition, in particular the at least one first powdered phase, that which has been described above applies to the cleaning agents according to the invention. It is preferable in this case for the at least one first phase to be powdered and free-flowing. Granular mixtures of a solid composition, in particular powders and/or granules having a free-flowing ability in %, compared with the above-mentioned standard test substance, of greater than 40%, preferably greater than 45%, in particular greater than 50%, more preferably greater than 55%, particularly preferably greater than 60%, are particularly suitable, the free-flowing ability being measured 24 hours following the production of the powder and storage at 20° C.

Analogously, what has been described for the at least one first phase with respect to the angle of repose also applies in this process.

For the at least one second phase to be used in the method according to the invention, the same applies as that which has been stated above, to which reference is explicitly made. A particular suitability of the second phases described above for the latter method lies in the fact that the rapid setting times of the gel phases, in particular the phases having PVOH as a polymer, significantly shorten the step of leaving the second phase(s) to set or even render said step unnecessary.

In this connection, very particularly preferred embodiments of the present invention comprise, as at least one second phase, 8 to 20 wt. % PVOH, 15 to 30 wt. % 1,3-propanediol, 30 to 40 wt. % glycerin, 5 to 15 wt. % sulfonic acid group-containing polyacrylate copolymer, optionally 2 to 10 wt. % 1,2-propanediol, and optionally 2-15 wt. % triethylene glycol or polyethylene glycol (preferably having an average molar mass of 200-600 g/mol), the wt. % in each case being based on the total weight of the second phase.

Depending on the production method, the second phase(s) may be significantly above or below the sealing seam plane (former method) or approximately at the level of the sealing seam plane (latter method).

The present application also relates to a method for cleaning hard surfaces, in particular dishes, in which the surface is worked in an inherently known manner using a cleaning agent according to the invention. In particular, the surface is brought into contact with the detergent or cleaning agent according to the invention. The cleaning is performed in particular using a cleaning machine, preferably a dishwasher.

The present invention also relates to the use of a cleaning agent for cleaning hard surfaces, in particular dishes, in particular in dishwashers.

In a preferred embodiment, the present application relates to automatic dishwashing detergent. In terms of the present application, automatic dishwashing detergents are compositions that can be used to clean soiled dishes in an automatic dishwashing process. The automatic dishwashing detergents according to the invention thus differ from automatic rinse aids, which are always used in combination with automatic dishwashing detergents and do not have any cleaning effect of their own.

Insofar as it is stated in the present application that the detergent or cleaning agent according to the invention comprises something overall or in the at least one first phase or in the at least one second phase, this shall also be regarded as disclosing the fact that detergents or cleaning agents, or the relevant phase, can consist thereof. In the following practical example, the detergent or cleaning agent according to the invention is described in a non-limiting manner.

Practical Examples

Cleaning agents according to the invention were produced which comprised a first phase and a second phase. Different geometries were realized in the process. In addition, cleaning agents were produced that comprised two first phases and one second phase. The following specifications refer to wt. % of active substance based on the total weight of the particular phase (unless indicated otherwise).

TABLE 1

The first granular mixtures of a solid composition, in particular powdered and free-flowing phases, had the following composition:

| | wt. % |
|---|---|
| Citrate, Na salt | 10-25 |
| Phosphonate (e.g. HEDP) | 0-10 |
| MGDA, Na salt | 0-40 |
| Disilicate, Na salt | 0-40 |
| Soda | 10-30 |
| Percarbonate, Na salt | 5.0-20.0 |
| Bleach catalyst (preferably Mn-based) | 0.0-0.8 |
| Bleach activator (e.g. TAED) | 1.0-4.0 |
| Non-ionic surfactant(s), e.g. fatty alcohol alkoxylate, preferably 20-40 EO, optionally end-capped | 1.5-15.0 |
| Polycarboxylate | 0.5-15 |
| Cationic copolymer | 0.0-1.0 |
| Disintegrant-(e.g. crosslinked PVP) | 0.0-3.0 |
| Protease preparation (tq) | 1.0-7 |
| Amylase preparation (tq) | 0.2-6 |
| Silver protection (e.g. benzotriazole or cysteine) | 0.0-1.0 |
| Perfume | 0.0-0.5 |
| Dye solution | 0.0-1.5 |
| Zn salt (e.g. acetate) | 0.01-0.5 |
| Sodium sulfate | 0.0-25 |
| Water | 0.0-3 |
| pH adjuster (e.g. citric acid) | 0.0-5 |
| Processing auxiliaries | 0-10 |

TABLE 2

In addition, first, free-flowing phases were produced which had the following composition:

| | wt. % |
|---|---|
| Citrate, Na salt | 15-20 |
| Phosphonate (e.g. HEDP) | 2.5-7.5 |
| MGDA, Na salt | 0-25 |
| Disilicate, Na salt | 5-35 |
| Soda | 10-25 |
| Percarbonate, Na salt | 10-15 |
| Bleach catalyst (preferably Mn-based) | 0.02-0.5 |
| Bleach activator (e.g. TAED) | 1-3 |
| Non-ionic surfactant(s), e.g. fatty alcohol alkoxylate, preferably 20-40 EO, optionally end-capped | 2.5-10 |
| Polycarboxylate | 4-10 |
| Cationic copolymer | 0-0.75 |
| Disintegrant-(e.g. crosslinked PVP) | 0-1.5 |
| Protease preparation (tq) | 1.5-5 |
| Amylase preparation (tq) | 0.5-3 |
| Silver protection (benzotriazole or cysteine) | 0-0.5 |
| Perfume | 0.05-0.25 |
| Dye solution | 0.0-1 |
| Zn salt (e.g. acetate) | 0.1-0.3 |
| Sodium sulfate | 0.0-10 |
| Water | 0.0-1.5 |
| pH adjuster (e.g. citric acid) | 0-1.5 |
| Processing auxiliaries | 0-5 |

A water-soluble wrapping in the form of an open pouch was produced by deep-drawing a PVOH-containing film. A liquid composition was poured into said open cavity and resulted in the second phase after curing, then first phases in the form of a free-flowing solid were poured into a pouch comprising polyvinyl alcohol, and the open pouch was then sealed by applying a second film and sealing by heat sealing.

TABLE 3

The second phases used in this case had the following composition:

| | wt. % |
|---|---|
| Glycerin | 10-50 |
| Propanediol (preferably 1,3-propanediol) | 10-50 |
| Polycarboxylate homo- and/or copolymer having sulfonic acid-containing groups | 0-30 |
| Non-ionic surfactant(s), e.g. fatty alcohol alkoxylate, preferably 20-40 EO, optionally end-capped | 0-40 |
| Polyethylene glycol avg. molar mass 1,000-2,000 | 0-20 |
| Thickener (preferably gelatin or PVOH) | 5-50 |
| Processing auxiliaries | 0-10 |
| Dye solution | 0.0-1.5 |

TABLE 4

Additional second phases having the following composition were produced:

| | wt. % |
|---|---|
| Glycerin | 20-45 |
| Propanediol (preferably 1,3-propanediol) | 10-30 |
| Polycarboxylate; homo- and/or copolymer having sulfonic acid-containing groups | 5-20 |
| Non-ionic surfactant(s), e.g. fatty alcohol alkoxylate, preferably 20-40 EO, optionally end-capped | 5-25 |
| Polyethylene glycol avg. molar mass 1,000-2,000 | 0-8 |
| Thickener (preferably gelatin or PVOH) | 10-20 |
| Processing auxiliaries | 0-5 |
| Dye solution | 0.0-0.5 |

The first and second phases were able to be combined with each other in any desired manner. The spatial configuration of the second phase, which was liquid after mixing of the ingredients and dimensionally stable within a setting time of from approximately 10 to 15 minutes, was predetermined by the spatial configuration of the first phase and by molds that are customary in the trade or self-designed. The liquid second phase was introduced into said molds and, after the setting time, the molds were removed without altering the second phase.

TABLE 5

Further examples of second phases having PVOH as a polymer:

| | G1 | G2 | G3 | G4 | G5 |
|---|---|---|---|---|---|
| PEG 400 | 17.9 | 23.1 | 23.1 | 13.9 | 27.8 |
| 30% PVOH in glycerin | 35.7 | 30.8 | 30.8 | 55.6 | 55.6 |
| 1,3-propanediol | — | — | — | 27.8 | 13.9 |
| Glycerin | — | 15.4 | — | — | — |
| Sulfonic acid-containing acrylate copolymer | — | 30.8 | 30.8 | — | — |
| Xylitol | 26.8 | — | — | — | |
| Water | 10.7 | — | 15.4 | — | — |
| Non-ionic surfactant 1 | 8.9 | — | — | — | — |
| Non-ionic surfactant 2 | — | — | — | 2.8 | 2.8 |

TABLE 6 further second phases having gelatin as a polymer

| | G6 | G7 | G8 |
|---|---|---|---|
| Gelatin, bloom number 225 | 29.2 | 25.8 | 24.7 |
| 1,3-propanediol | 47.6 | 41.9 | 40.2 |
| EHPD* | 23.2 | 23.6 | 26.8 |

TABLE 6-continued further second phases having gelatin as a polymer

| | G6 | G7 | G8 |
|---|---|---|---|
| Water | — | 6.5 | 6.2 |
| Non-ionic surfactant 2 | — | 2.2 | 2.1 |

*EHPD = 2-ethy1-2-(hydroxymethyl)-1,3-propanediol

What is claimed is:

1. A detergent or cleaning agent portion comprising a water-soluble wrapping having at least one continuous circumferential sealing seam that lies in one plane, and at least one first phase and at least one second phase different therefrom, wherein the at least one first phase comprises a granular mixture of a solid composition, and wherein the at least one second phase comprises:

from 10 to 40 wt. % of at least one polymer comprising gelatin or polyvinyl alcohol;

from 1 to 35 wt. % of a sulfopolymer from 5 to 75 wt. % of at least one polyhydric alcohol, from 0 to 2 wt. % water, and from 0 to 0.5 wt. % anionic surfactant, each based on the total weight of the at least one second phase.

2. The detergent or cleaning agent portion according to claim 1, wherein the at least one second phase further comprises at least two polyhydric alcohols, a first polyhydric alcohol being an alkanetriol and a second polyhydric alcohol being an alkanediol.

3. The detergent or cleaning agent portion according to claim 2, wherein the first polyhydric alcohol is a $C_3$ to $C_{10}$ alkanetriol and wherein the second polyhydric alcohol is a $C_3$ to $C_{10}$ alkanediol.

4. The detergent or cleaning agent portion according to claim 3, wherein the first polyhydric alcohol is further defined as a $C_3$ to $C_8$ alkanetriol.

5. The detergent or cleaning agent portion according to claim 4, wherein the first polyhydric alcohol is glycerin and/or 1,1,1-trimethylolpropane and/or 2-amino-2-(hydroxymethyl)-1,3-propanediol.

6. The detergent or cleaning agent portion according to claim 3, wherein the second polyhydric alcohol is further defined as a $C_3$ to $C_8$ alkanediol.

7. The detergent or cleaning agent portion according to claim 3, wherein the two OH groups of the alkanediol are not arranged on immediately adjacent C atoms of the alkyl chain.

8. The detergent or cleaning agent portion according to claim 7, wherein the two OH groups of the alkanediol are not arranged on immediately adjacent C atoms of the alkyl chain, and wherein three or four carbon atoms are located between the two OH groups.

9. The detergent or cleaning agent portion according to claim 1, wherein the at least one second phase further comprises a non-ionic surfactant.

10. The detergent or cleaning agent portion according to claim 1, wherein the at least one polymer comprises gelatin and wherein the at least one second phase further comprises: a polyethylene glycol having an average molar mass of from 1,000 to 2,000 g/mol, where the polyethylene glycol is present in the at least one second phase in an amount of from 5 to 10 wt. %, based on the total weight of the at least one second phase.

11. The detergent or cleaning agent portion according to claim 1, wherein the sulfopolymer is further defined as a sulfonic acid group-containing acrylate copolymer.

12. The detergent or cleaning agent portion according to claim 1, wherein the at least one polymer comprises polyvinyl alcohol and wherein the at least one second phase further comprises: a polyethylene glycol having an average molar mass of from 300 to 800 g/mol, where the polyethylene glycol is present in the at least one second phase in an amount of from 10 to 30 wt. %, based on the total weight of the at least one second phase.

13. The detergent or cleaning agent portion according to claim 1, wherein a weight ratio of the at least one first phase to the at least one second phase is 40:1 to 2:1.

14. The detergent or cleaning agent portion according to claim 1, wherein the water-soluble wrapping comprises polyvinyl alcohol.

15. The detergent or cleaning agent portion according to claim 1, that is further defined as a dishwashing detergent.

16. A method for automatically cleaning dishes, comprising the step of using the detergent or cleaning agent portion according to claim 1 in a dishwasher.

17. A method for producing the detergent and/or cleaning agent portion according to claim 1, the method comprising:

a) providing a mold having at least one mold cavity; optionally containing a partition for dividing the base of the mold cavity;
b) adding a water-soluble film onto the mold cavity;
c) forming an open chamber in the mold cavity by deforming the water-soluble film;
d) filling the open chamber with the at least one second phase;
e) optionally leaving the at least one second phase to set;
f) subsequently filling the open chamber with the at least one first phase;
g) providing a second water-soluble film as a cover;
h) superimposing the open chamber and the cover; and
i) sealing the cover with the open chamber.

18. A method for producing the detergent and/or cleaning agent portion according to claim 1, the method comprising:

a) providing a mold having at least one mold cavity; optionally containing a partition for dividing the base of the mold cavity;
b) adding a water-soluble film onto the mold cavity;
c) forming an open chamber in the mold cavity by deforming the water-soluble film;
d) filling the open chamber with the at least one first phase;
e) providing a second mold having at least one second mold cavity; optionally containing a partition for dividing the base of the mold cavity;
f) adding a second water-soluble film onto the second mold cavity;
g) forming a second open chamber in the second mold cavity by deforming the water-soluble film;
h) filling the second open chamber or parts thereof with the at least one second phase;
i) optionally leaving the at least one second phase) to set;
j) superimposing the two open chambers; and
k) sealing the open chambers together.

* * * * *